US010329771B2

(12) United States Patent
Prevatt et al.

(10) Patent No.: US 10,329,771 B2
(45) Date of Patent: Jun. 25, 2019

(54) RETROFIT/REPAIR TECHNIQUE FOR ASPHALT SHINGLE ROOFS THAT EXHIBIT PREMATURE ADHESIVE TAB SEAL FAILURES

(71) Applicant: University of Florida Research Foundation, Inc., Gainesville, FL (US)

(72) Inventors: David O. Prevatt, Gainesville, FL (US); Kurtis R. Gurley, Gainesville, FL (US); Craig R. Dixon, Golden, CO (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 15/436,307

(22) Filed: Feb. 17, 2017

(65) Prior Publication Data

US 2017/0159297 A1 Jun. 8, 2017

Related U.S. Application Data

(63) Continuation of application No. PCT/US2015/051473, filed on Sep. 22, 2015.
(Continued)

(51) Int. Cl.
*E04D 15/02* (2006.01)
*E04D 15/06* (2006.01)
(Continued)

(52) U.S. Cl.
CPC ..... *E04D 15/02* (2013.01); *E04D 1/34* (2013.01); *E04D 15/06* (2013.01); *E04D 15/07* (2013.01); *E04D 2001/3435* (2013.01)

(58) Field of Classification Search
USPC ..... 118/407, 410–414; 401/139, 48, 9; 156/578; 111/7.1
See application file for complete search history.

(56) References Cited

U.S. PATENT DOCUMENTS 2,804,767 A 9/1957 Schoen
3,016,040 A 1/1962 Crookston
(Continued)

OTHER PUBLICATIONS

University of Florida Research Foundation, Inc., PCT Application No. PCT/US2015/051473 filed Sep. 22, 2015, Notification of Transmittal of the International Search Report and the Written Opinion of the International Searching Authority, or the Declaration dated Dec. 29, 2015, 12 pages.

*Primary Examiner* — Yewebdar T Tadesse
(74) *Attorney, Agent, or Firm* — Thomas Horstemeyer, LLP

(57) ABSTRACT

Devices, systems and methods for providing a retrofit and repair technique and device for asphalt shingle roof coverings or roofing systems that exhibit premature adhesive tab seal failures. A device can have a handle at one end and a blade tip end at the other end has the blade tip inserted under a shingle to be repaired. The device can dispense a row of "dabs" at a selected location under roof shingle(s). The dispenser can dispense a row of individual "dabs" by a volume container. Alternatively, the dispenser can have a roll with a plurality of rows of pre-made "dabs" of adhesive on removable type paper. Once the blade tip end of the tool device is inserted between upper and lower shingles, the dabs are dispensed by removing the release paper, and the device is pulled out with the release tape is wound up, advancing the adhesive cylinders. Next, the worker can press down on the upper shingle. Additional embodiments can include adhesive adapters having dispensing heads that attach to ends of caulking tubes on caulking guns, or to caulking gun cartridges, and the like.

20 Claims, 30 Drawing Sheets

Related U.S. Application Data

(60) Provisional application No. 62/053,521, filed on Sep. 22, 2014, provisional application No. 62/200,410, filed on Aug. 3, 2015.

(51) Int. Cl.
*E04D 1/34* (2006.01)
*E04D 15/07* (2006.01)

(56) References Cited

U.S. PATENT DOCUMENTS

| | | | | |
|---|---|---|---|---|
| 3,099,582 | A | 7/1963 | Ongstad | |
| 3,150,407 | A * | 9/1964 | Mitchell | A63D 5/10 15/98 |
| 3,155,544 | A | 11/1964 | McConnell | |
| 3,173,166 | A | 3/1965 | Christensen | |
| 3,374,049 | A | 3/1968 | Taylor | |
| 4,542,040 | A * | 9/1985 | Nowak | B05B 7/1495 118/308 |
| 5,085,701 | A | 2/1992 | Muller | |
| 6,120,203 | A | 9/2000 | Modders | |
| 6,247,289 | B1 | 6/2001 | Karpinia | |
| 6,968,662 | B2 | 11/2005 | Rodrigues | |
| 7,954,299 | B2 | 6/2011 | Platts | |
| 8,524,836 | B2 | 9/2013 | Kavanagh | |
| 2007/0209296 | A1 | 9/2007 | Gage | |
| 2009/0220720 | A1 | 9/2009 | Mohseen | |
| 2013/0075027 | A1 | 3/2013 | Sheridan | |

* cited by examiner

FIGURE 18

Section 3 - Composition/Information on Ingredients

| Hazardous Components | | | | | |
|---|---|---|---|---|---|
| Chemical Name | Identifiers | %(weight) | LD50/LC50 | Classifications According to Regulation/Directive | |
| Asphalt | CAS:8052-42-4<br>UN:NA1999<br>EINECS:232-490-9 | 40% TO 60% | Ingestion/Oral-Rat LD50 • >5000 mg/kg<br>Inhalation-Rat LC50 • >94.4 mg/m³ | WHMIS: Other Toxic Effects - D2A<br>UN GHS: Carc. 2; Eye Irrit. 2A; Skin Irrit. 2<br>EU DSD/DPD: | |
| Mineral Spirits | CAS:8052-41-3<br>EC Number:232-489-3<br>EINECS:232-489-3 | 15% TO 30% | | EU DSD/DPD: Carc.Cat.2; R45 Muta.Cat.2; R46 Xn; R65 | |
| Kaolin | CAS:1332-58-7 | 5% TO 15% | | UN GHS: Eye Irrit. 2A; STOT RE 2<br>EU DSD/DPD: Irritant(Xi); R36/37 | |
| Cellulose | CAS:9004-34-6<br>EINECS:232-674-9 | 6% TO 10% | Ingestion/Oral-Rat LD50 • >5 g/kg<br>Inhalation-Rat LC50 • >5800 mg/m³ 4 Hour(s)<br>Skin-Rabbit LD50 • >2 g/kg | WHMIS: Other Toxic Effects - D2B<br>UN GHS: Eye Irrit. 2A; Skin Irrit. 2<br>EU DSD/DPD: | |
| Hydrated aluminum-magnesium silicate | CAS:12174-11-7 | 5% TO 10% | | WHMIS: Other Toxic Effects - D2A<br>UN GHS: Carc. 2; STOT RE 2<br>EU DSD/DPD: Carcinogen 2(Carc.Cat.2); R49; Toxic(T) | |
| Solvent naphtha (petroleum), light aromatic | CAS:64742-95-6<br>EC Number:265-199-0<br>EINECS:265-199-0 | 1% TO 5% | | UN GHS: Asp. Tox. 1; Carc. 1B<br>EU DSD/DPD: Carc.Cat.2; R45Muta.Cat.2; R46Xn; R65 | |
| Styrene/Butadiene Polymer | CAS:9003-55-8 | 1% TO 5% | | | |
| Quartz | CAS:14808-60-7<br>EC Number:238-878-4<br>EINECS:238-878-4 | 1% TO 2% | | UN GHS: Carc. 1A; STOT RE 1<br>EU DSD/DPD: Carcinogen 1(Carc.Cat.1); R49 | |
| 1,2,4-Trimethylbenzene | CAS:95-63-6<br>EC Number:202-436-9<br>EINECS:202-436-9 | 0.5% TO 1.5% | Ingestion/Oral-Rat LD50 • 5 g/kg<br>Inhalation-Rat LC50 • 18000 mg/m³ 4 Hour(s)<br>Ingestion/Oral-Mouse LD50 • 6900 mg/kg | UN GHS: Acute Tox. 4 (Inhalation); Aquatic Chronic 2; Flam. Liq. 3; Eye Irrit. 2A; Skin Irrit. 2; STOT RE 2; STOT SE 2<br>EU DSD/DPD: R10Xn; R20Xi; R36/37/38N; R51 R53 | |
| Benzene, 1,3,5-trimethyl | CAS:108-67-8<br>EC Number:203-604-4<br>UN:UN2325<br>EINECS:203-604-4 | 0.5% TO 1.5% | | EU DSD/DPD: R10 Xi; R37 N; R51 R53 | |

TOP VIEW OF NOZZLE FROM FIGURE 22

RETROFIT/REPAIR TECHNIQUE FOR ASPHALT SHINGLE ROOFS THAT EXHIBIT PREMATURE ADHESIVE TAB SEAL FAILURES

CROSS REFERENCE TO RELATED APPLICATIONS

This application is a Continuation of PCT Patent Application PCT/US2015/051473 filed Sep. 22, 2015, which claims the benefit of priority to U.S. Provisional Patent Application Ser. No. 62/053,521 filed Sep. 22, 2014 and U.S. Provisional Patent Application Ser. No. 62/200,410 filed Aug. 3, 2015. The entire disclosure of each of the applications listed in this paragraph are incorporated herein by specific reference thereto.

GOVERNMENT LICENSE RIGHTS

This invention was made with Government support under US Department of Commerce contract NA10OAR4170079 awarded by the US Department of Commerce. The government has certain rights in this invention.

FIELD OF INVENTION

This invention relates to asphalt shingle roofs, and in particular to devices, systems and methods for providing a retrofit and repair technique and handheld devices for asphalt shingle roofs that exhibit premature adhesive tab seal failures, where dabs or puddles of adhesive are dispensed in selected spaced apart locations between partially unsealed shingles.

BACKGROUND AND PRIOR ART

A majority of wind damage from hurricanes occurs with single family residential homes, and the majority of these homes are six years or older. It is estimated that approximately 60% of the hurricane-induced damage and losses occur to the roofs, including loss of roof shingles and underlayment. A major source of roof damage is the failure of asphalt single roofs from moderately strong winds. A majority of these failures has been linked to the tendency of shingle adhesive tabs (tabs) to prematurely unseal, with time as the roof ages. There is a high likelihood that roofs 6 years old and older would have unsealed tabs, which are directly linked to failures of the roofing in strong winds.

Research has shown that as shingle roofs age, weathering effects on the shingle tabs causes the adhesive along the leading edge of the shingle to fail. This typically occurs in systemic fashion on a roof from the overlap of the vertical joints between shingles in the lower row of shingles to the nearest vertical end joint of the shingle. This results in patterns of vertical or diagonal lines of partially unsealed shingles (depending on how they are installed). Post-storm investigations have documented roof failures with similar failure patterns in the roofing as was observed in the systemic patterns of failed roofing shingles.

As a result, the loosely attached shingle tabs are susceptible to flap in the wind which produces higher wind loads on the shingle tabs and results in premature failure in high wind events. The flapping action reduces the useful life of the roofing system and cause shingles to break off and underlayment to fail. This can be a significant contribution to enabling water intrusion to occur which causes extensive damage to residential homes interior partitions and to the contents during and after hurricanes.

Currently, roofers have been known to try and use caulking guns that dispense an asphalt product, such as BLACKJACK™, and the like. Shingle manufacturers have even recommended placing a "quarter-sized" dab on the lower shingle. However, the current technique requires the roofer to have to separately dispense the "dab", at every point, which is difficult to accomplish with a caulking gun.

In addition to the difficulty of handling the caulking gun to control volume of the material being dispensed, the gun tip requires the shingle to be bent upward (due to the size of the gun and dispensing tube), which can cause brittle shingle(s) to break, causing more damage that cannot be easily repaired.

Additionally, the caulking gun adhesive is made of a material that needs time to cure. It is applied as a tacky liquid but the adhesive does not achieve its strength until the volatile organic compounds (VOCs) are evaporated and the compound hardens. This curing process can take several days to weeks depending on several factors (temperature of roof, for example). Further the roofer must be careful not to put too large a volume of the adhesive as this can lead to "blistering" of the shingle surface which causes the repair adhesive to fail prematurely.

Standard caulking guns are not intended to repair the failed sealant tabs in partially sealed asphalt shingle roofing systems. Standard caulking guns are intended to dispense large volumes (up to approximately 1 to approximately 3 oz) that generally would need to be spread using a trowel. The use of too much adhesive can cause blistering of the shingle that can prevent the sealant from taking hold and can also damage the shingle substrate.

The use of caulking guns does not allow for uniform fixes to all shingle tabs, and is time consuming for the worker doing the repairs. Also, the caulking gun use does not provide immediate feedback that the repair has worked to seal the tabs. Furthermore, the use of the caulking gun repairs is difficult to verify to prevent further problems down the road and is difficult to certify by insurance companies.

Thus, the need exists for solutions to the above problems with the prior art.

SUMMARY OF THE INVENTION

A primary objective of the present invention is to provide devices, systems and methods for retrofitting and repairing asphalt shingle roofs that exhibit premature adhesive tab seal failures.

A secondary objective of the present invention is to provide devices, systems and methods for retrofitting and repairing and resealing asphalt shingle roof tabs in a single application requiring little skill to learn.

A third objective of the present invention is to provide devices, systems and methods for retrofitting, repairing and resealing asphalt shingle roof tabs which will restore or exceed the strength of other shingle tabs on the roof, and will substantially reduce the vulnerability of the entire roof system to losses, which will prevent a roof covering or roofing system from blowing off, with resulting water ingress, collapsed ceilings and mold growth that can lead to costly damage approaching the insured home value.

A fourth objective of the present invention is to provide devices, systems and methods for retrofitting, repairing and resealing asphalt shingle roof tabs that eliminates the use of caulking guns or can be used with existing caulking guns, and requires minimal flexing of the shingles.

A fifth objective of the present invention is to provide devices, systems and methods for retrofitting, repairing and resealing asphalt shingle roof tabs that dispenses the same uniform volume of adhesive every time, where the chemical composition of the adhesive provides immediate tack so that the repair will seal immediately, and cure to full strength within one week.

A sixth objective of the present invention is to provide devices, systems and methods for retrofitting, repairing and resealing asphalt shingle roof tabs that provides both a controlled volume and a controlled placement of the new adhesive.

A seventh objective of the present invention is to provide devices, systems and methods for retrofitting, repairing and resealing asphalt shingle roof tabs which minimally disturbs the asphalt shingle with minimal or no bending by the installer.

An eighth objective of the present invention is to provide devices, systems and methods for retrofitting, repairing and resealing asphalt shingle roof tabs which enables the repair by roofing contractors and by untrained persons to be done consistently and in reasonably fast times (under approximately 4 hours for an average 2,000 square foot home).

A ninth objective of the present invention is to provide devices, systems and methods for retrofitting, repairing and resealing asphalt shingle roof tabs, which reduces the risk of asphalt shingle roofing failure from hurricane and tornado winds, thereby reducing damage and economic loss from water leaks into the buildings.

A tenth objective of the present invention is to provide devices, systems and methods for retrofitting, repairing and resealing asphalt shingle roof tabs that increases the productivity of the worker to repair the seal tabs with a customized tool which fits its' purpose and simplifies the method of installation.

An eleventh objective of the present invention is to provide devices, systems and methods for retrofitting, repairing and resealing asphalt shingle roof tabs that provides immediate feedback that the tab has been sealed.

A twelfth objective of the present invention is to provide devices, systems and methods for retrofitting, repairing and resealing asphalt shingle roof tabs, that is safer for the worker(s) doing the roof repairs.

A thirteenth objective of the present invention is to provide devices, systems and methods for retrofitting, repairing and resealing asphalt shingle roof tabs, that is easily verified to be used to certify thoroughness of the repair, which can be necessary for insurance premium reductions.

A fourteenth objective is to provide a means to dispense the existing adhesive in a more consistent manner, as a modified improvement on a caulking gun.

An embodiment of the applicator device for repairing shingle tabs on roofs, can include a frame having a front blade tip end and a rear end, a handle attached to the rear end of the device, and a dispenser on the device for dispensing a row of adhesive dabs, wherein the device uniformly dispenses the row of adhesive dabs at selected locations behind the blade tip end under a free edge of a shingle tab.

The device can include a threaded male and female coupling for attaching the handle to the rear end of the device.

The dispenser can include a volume storage container for simultaneously dispensing the row of the dabs.

The dispenser can include a roll of adhesive dabs mounted on the device, and the device can include a spool for supporting the roll on the device.

The dispenser can further include a guide stop back wall between the spool and the blade tip end, with a slot in the back wall for allowing an outer end of a sheet from the roll to be passed therethrough.

The device can further include a compressed air source for cleaning under the shingle before using the applicator device.

Each of the adhesive dabs can include a width of approximately 0.25 inches, a thickness of approximately 1/16 inch, and each dab can be spaced apart from another by approximately 1 inch.

Another applicator device embodiment for repairing shingle tabs on roofs, can include a hand operated and hand supported tool having a front lift end with a tip, a rear end, a top and a bottom, a handle attached to the tool, and a dispenser adjacent to the front lift end for dispensing a plurality of adhesive puddles through the front lift end of the tool, wherein the device uniformly dispenses the row of adhesive puddles at selected locations between partially unsealed shingles.

The device can include a container of liquid adhesive under pressure attached to the tool. The device can include an air compressor attached to the container for applying the pressure to the liquid adhesive, and a switch for causing a selected amount of the liquid adhesive under pressure to dispense out of the lifting end of the device. The switch can be a squeezable trigger for causing the dispensing of the plurality of adhesive puddles. The handle on the device can be attached to the top of the tool.

The lifting end of the tool can have a sloped pitch of approximately 11 degrees, and can include a plurality of parallel channels formed in metal, the channels for dispensing the adhesive in spaced apart locations. Each of the channels can be approximately 0.03 inches high by approximately 0.06 inches wide, and spaced apart approximately 1 inch between centers of each channel. The plurality of channels can include two, three or four or more channels.

The lift end of the tool can include an angled metal lift layer with a sloped pitch angle, a metal base layer having the channels for dispensing the adhesive, and a middle metal plate between the metal lift layer and the metal base layer. The angled lift layer can include a tip tapered to a thin plate edge. The lift end can include a sloping tip width of approximately 4 inches by approximately 2 to approximately 3 inches depth. The lift end can include a plurality of parallel replaceable tubes for dispensing the adhesive in spaced apart locations, and the plurality of parallel replaceable tubes can be spaced apart approximately 1 inch between centers of each channel.

The applicator device can further include a pivotable roller for between moveable between a retracted position and an extended position for being used after the dispensing of the liquid from the tool.

The dispenser device can dispense puddles of adhesive that can each include a width of approximately 0.25 inch.

The handle can be an elongated handle having one end attached to the tool and an opposite end having switch for activating the dispensing of the adhesive from the lifting end of the tool.

Another applicator device embodiment for a caulking gun, can include a connector adaptable to be attached to a dispensing end of a caulking gun, a support having a first end for attaching to the connector and a second end, and a dispenser head having an adhesive input end attached to the second end of the support, and a lifting end, wherein the lifting end includes a narrow tip with outlets for dispensing adhesive from the caulking gun therefrom.

The dispensing head can be formed from metal layers with channels formed in at least one of the metal layers for dispensing the adhesive therefrom. The channels can include up to approximately five dispensing channels, each having dispensing outlets.

Further objects and advantages of this invention will be apparent from the following detailed description of the presently preferred embodiments which are illustrated schematically in the accompanying drawings.

BRIEF DESCRIPTION OF THE FIGURES

FIG. 18 is a table of a preferred adhesive for use with the repair device of the preceding figures.

DESCRIPTION OF THE PREFERRED EMBODIMENTS

Figure 1:
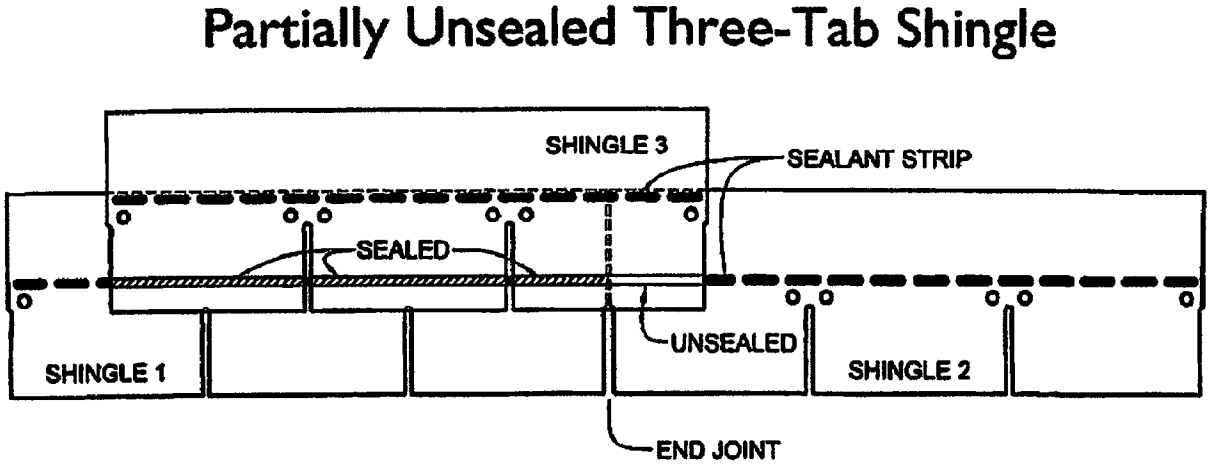
FIGURE 1 (Prior Art)
FIG. 1 is a prior art top view of a partially unsealed three-tab shingle roof arrangement.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 building/house
2 lower layer of shingles
4 upper layer of shingles
6 front edge of upper layer of shingles
8 roof
10 long handle repair tool device embodiment
20 front channel
22, 24 tapered sides
26 front blade tip end
28 bottom
30 backstop
35 slot in bottom of backstop
40 post(s) for rolls
42 lower spool for roll of PSA tape
48 upper spool for collector roll
50 inclined base
52 rear end of device
55 threaded rod
60 elongated handle
68 hollow lower end with internal threads
72 PSA tape roll
74 underside of tape
75 top of sheet

Figure 2:
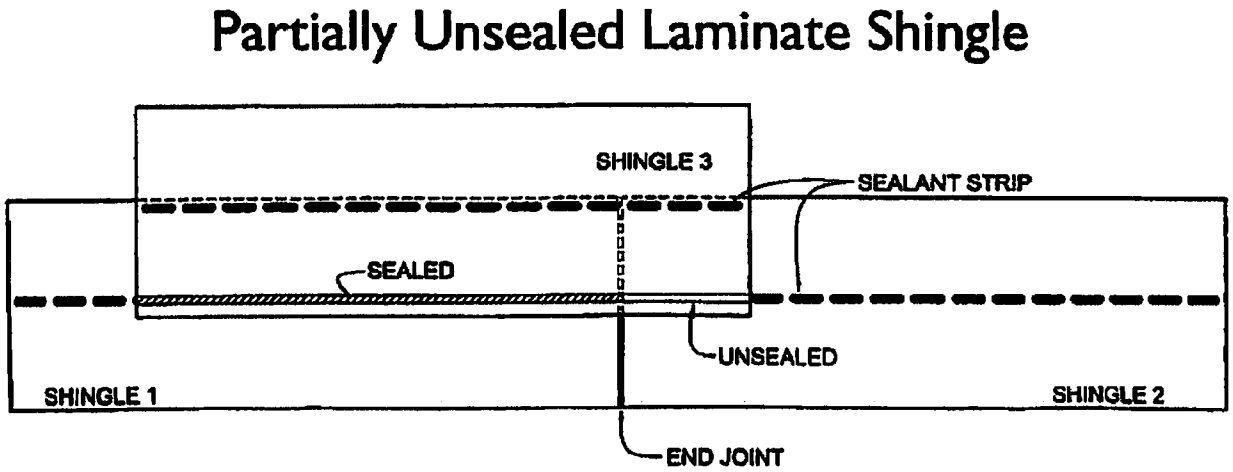
FIGURE 2 (Prior Art)
FIG. 2 is a prior art top view of a partially unsealed laminate shingle roof arrangement.

76 ¼" thick dabs
77 fibers/wire mesh
78 collector roll
100 handheld device embodiment
102 main housing
104/160 base plate (steel base removable for servicing)
106 front stand
108 rear stand
110 air actuated pressure roller
111 main support
112 parallel control arms
113 pivot points
114 extendable and retractable arm
115 roller activation switch
116 piston
118 air cylinder/actuator with regulator for roller 110
120 top handle with interior hydraulic adhesive pump
122 pull trigger
123 interior trigger hinge
124 adhesive reservoir and delivery chamber
126 conduit tube for passing adhesive supply from supply tank & actuation air supply from compressor to controls
130 guide stop
140 lift end
142 angled steel lift
144 thin plate/tip
150 aluminum plate
152 adhesive channels (four shown)
153 cut-outs (four shown)
154 pre-application chamber (tapered)
156 input line to pre-application chamber
157 tapered section of pre-application chamber
158 replaceable adhesive application tubes
159 lift noses taper for insertion
160/104 steel shoe
165 fasteners
170 adhesive supply source
172 liquid adhesive
173 adhesive container/pail
174 diaphragm (disk)
176 air pressure
178 adhesive delivery supply line
180 compressor
182 air line from compressor to adhesive supply source
184 air compressor hose for roller assembly
200 Extended rod caulking gun adapter embodiment
210 trigger squeezable caulking gun
222 connector for caulking tube tip
220 extension rod handle with inner tube
230 dispensing head
232 connector for dispensing head
234 dispensing tubes with bent ends
300 lifting dispenser adapter for caulking gun embodiment
310 caulking gun cartridge
320 connector (plastic connector)
330 feed line (aluminum feed line)
340 pipe (aluminum pipe)
345 fasteners (bolts, screws)
350 L-shaped guide stop
353 slots
355 fasteners (bolts, screws) for adjusting guide stop
360 steel lift plate
362 lifting ends
370 aluminum plate
372 channel openings
375 reservoir (interior channel)
380 steel base plate
385 fasteners (screws, and the like)
390 caulk gun FIG. 1 is a top view of a partially unsealed three-tab shingle roof arrangement, with an upper row of three-tab shingles (staggered or shifted) overlaying a lower row of three-tab shingles. FIG. 2 is a top view of a partially unsealed laminate shingle arrangement on a roof.

Referring to FIGS. 1-2, an unsealed area can be where the right side of the upper three-tab shingles overlays a left side of the lower three-tab shingles. The unsealing can occur from the vertical joint of the lower row of the shingles to the end of the shingle. Generally, the location of these unsealing areas occurs regularly at the end of the shingles.

Figure 3:
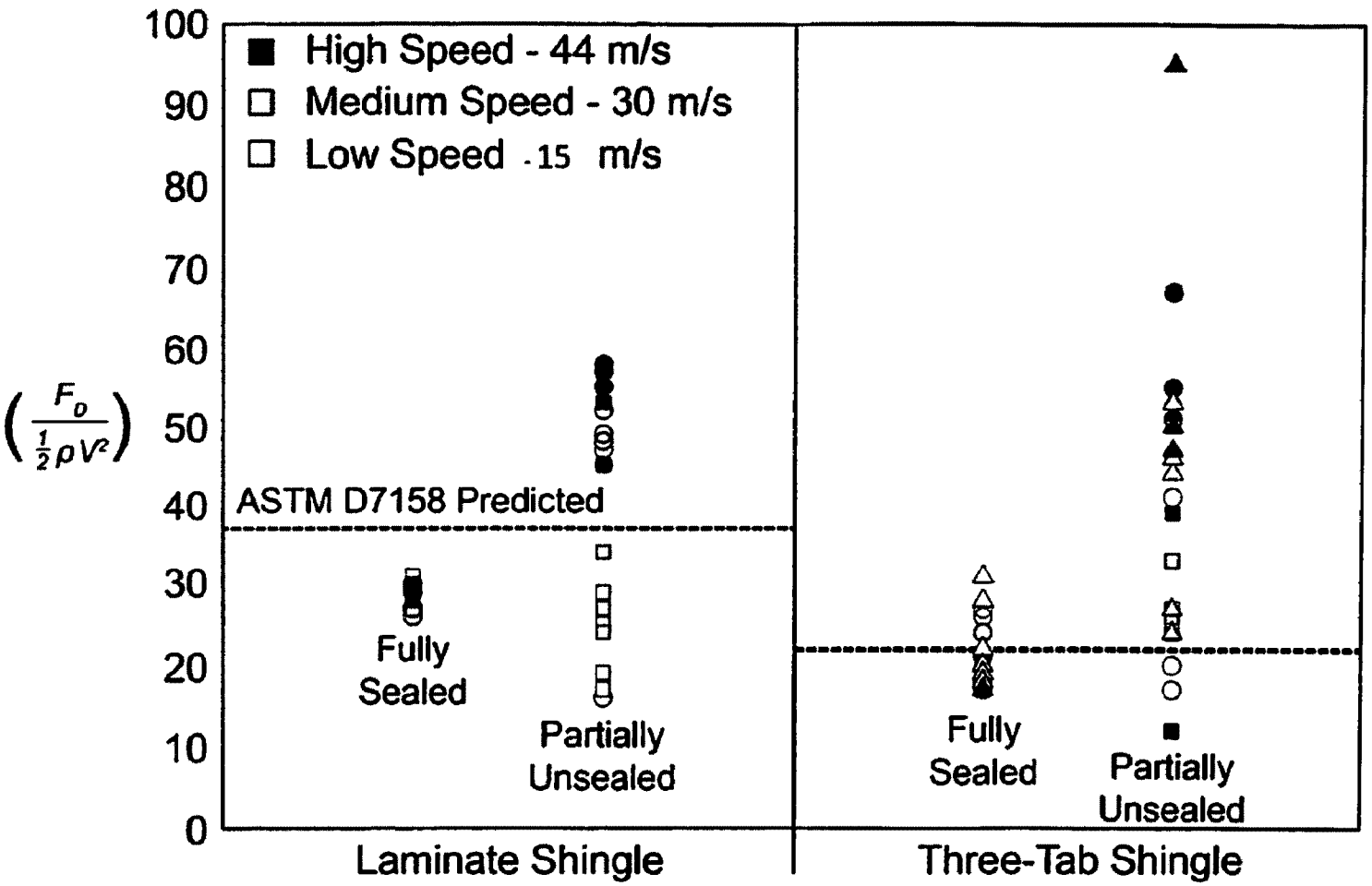
FIG. 3 is a graph of experimentally determined wind loads exerted on fully sealed Laminate and Three-Tab Shingles compared to partially unsealed Laminate and Three-Tab Shingles and in comparison to design-level wind loads.

FIG. 3 is a graph of fully sealed Laminate and Three-Tab Shingles compared to partially unsealed Laminate and Three-Tab Shingles. The vertical axis is a force coefficient between 0 and 100. For laminate shingles, the acceptable force coefficient is ASTM D7158 Predicted at approximately 38 on the scale. ASTM D7158, "Standard Test Method for Wind Resistance of Asphalt Shingles (Uplift Force/Uplift Resistance Method) is a consensus-based test protocol published by ASTM International. This test method covers the procedure for calculating the wind resistance of asphalt shingles when applied in accordance with the manufacturer's instructions, and sealed under defined conditions. It is the accepted industry-standard approach for determining wind resistance of asphalt shingles. Today, the ASTM D7158 test standard has been adopted by many building code agencies, and is accepted test protocol by building codes of most states.

For Three-tab shingles, the force coefficient is approximately 22 on the scale. The Florida building code and International Building Code use this force coefficient scale to evaluate and certify the wind uplift performance of roof shingles (laminate shingle and three-tab shingles).

High speed is at approximately 44 m/s (meters per second). Medium speed is at approximately 30 m/s and low speed is at approximately 15 m/s.

Each data point represents of a test of a type of roofing shingle subjected to wind uplift speeds. Fully sealed is defined as a shingle that is adhered along a complete front edge of an individual asphalt shingle. Partially sealed is defined as one in which the sealant tab adhered only partially along the front edge of the shingle. It was found that environmental exposure and natural aging processes can create systemic patterns of partially unsealed asphalt shingles. Each symbol represents a different asphalt shingle sample used as part of the test, represented by the "circle," triangle," and "square" symbols.

Referring to FIG. 3, a partially sealed asphalt shingle experiences a greater wind uplift force than a fully sealed shingle because the free tab at the unsealed portion of the shingle is deflected upwards by the wind flowing over the roof, creating a vertical front area and so producing far greater wind uplift force than is predicted by the design standard for fully sealed asphalt shingles (ASTM D7158), as shown in FIG. 3. Field observations following hurricanes and tornadoes, have found that failure patterns of asphalt shingles follow similar systematic patterns observed in partially sealed asphalt shingles, which suggest the those failures occur coincident with locations of partially unsealed asphalt shingles. Test data also confirms that partially sealed asphalt shingles are more vulnerable to wind-induced blow-off or damage than shingles that are fully sealed.

With the subject invention, the user can use the devices described below for resealing the section of sealant strip that is not sealed, one could reduce the potential of wind-induced damage on asphalt shingles.

Figure 4:
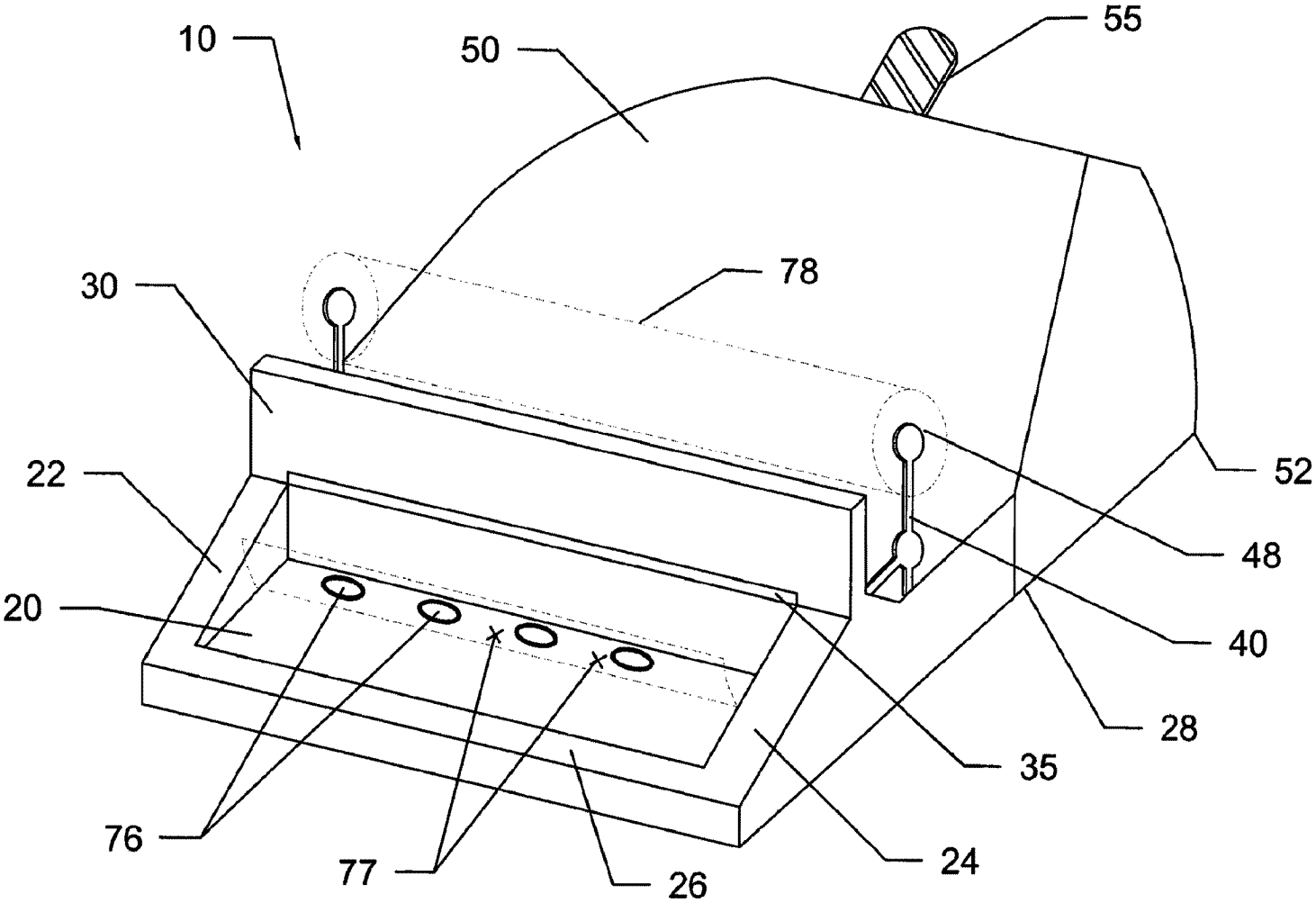
FIG. 4 is an upper perspective view of the novel repair device.
Figure 5:
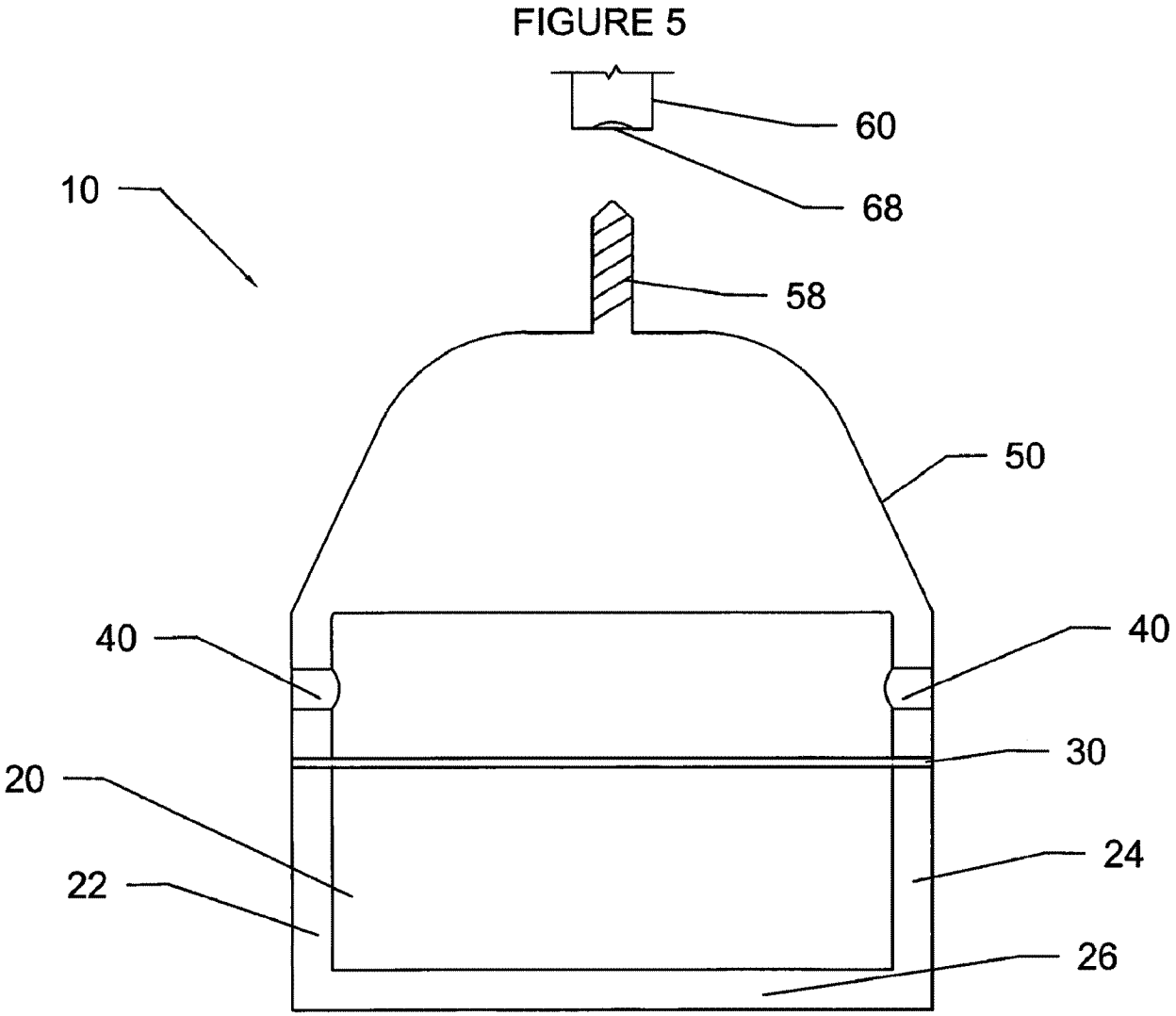
FIG. 5 is a top view of the novel repair device of FIG. 4.
Figure 6:
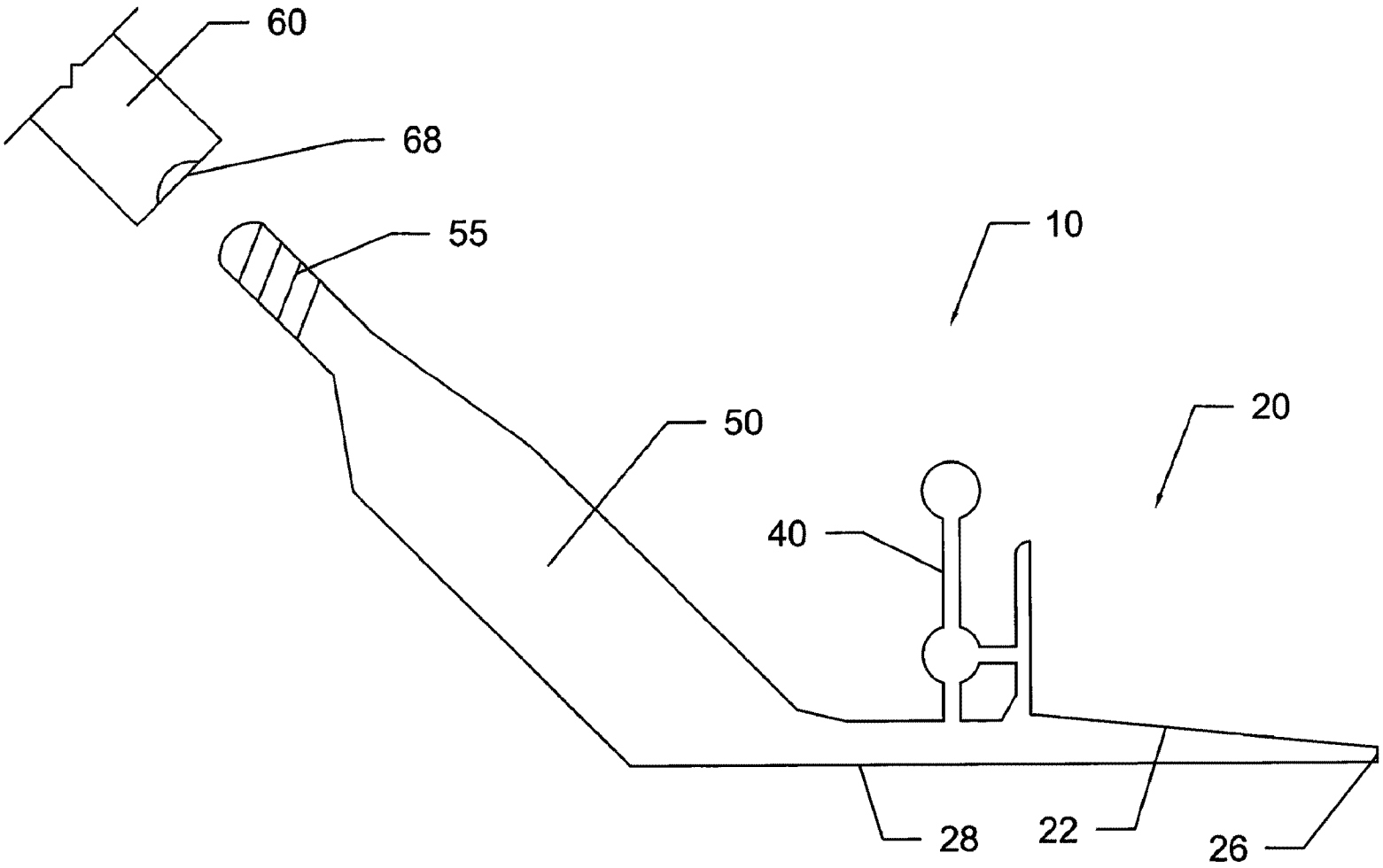
FIG. 6 is a side view of the novel repair device of FIG. 4.

FIG. 4 is an upper perspective view of the novel repair device 10. FIG. 5 is a top view of the novel repair device 10 of FIG. 4. FIG. 6 is a side view of the novel repair device 10 of FIG. 4.

Referring to FIGS. 4-6, the device 10 can have a length between a rear end 52 adjacent to the handle 60 and a front blade tip end 26 of the channel 20 of approximately 4 inches, and a width across the channel 20 of approximately 3 inches. The rear end 52 can have an inclined base 50 with a rearwardly angled threaded rod 55, which can be screwed into threaded hollow end 68 of an elongated handle 60. The elongated handle 60 can have a length of approximately 0.5 to approximately 2.5 ft. The term approximately, can include +/−10%.

The elongated handle 60 can allow for the device 10 to be held by the worker so that the flat bottom 28 can rest on the roof surface. The front tip end 26 of the channel can include tapered sides 22, 24 to a blade tip end 26 so that it provides minimal vertical displacement of the shingle when the device 10 is inserted between the shingles.

Across the face of the channel 20 can be a generally rectangular opening for supporting an edge of the tape end 74 herein. The adhesive can be dispensed as pre-measured cylinder shaped dabs 76 placed at regular spacing along a sheet 74, 75 (release paper) that is coated with a release agent. The paper 74, 75 is on the top side of the side of the adhesive dabs 76 and it serves as a manual advancing mechanism to position the dabs 76 at the appropriate location above the lower shingle, once the device is inserted between the shingles.

Thin Fiber connectors 78 (such as wire or plastic mesh) are used to connect the cylinder dabs 76 of adhesive together and to hold them in place in the roll 72. During installation as a single row of adhesive cylinder dabs 76 are placed between the shingles, then the sandwich of shingles is rolled from above to put pressure and get the lower surface of the adhesive cylinder dabs 76 into contact with the lower shingle and adhere to it.

Once this is established, the device 10 can be withdrawn pulling the release paper 74, 75 off the top of adhesive cylinder dabs 76 and the fibers connecting the next row of fasteners is broken. The release paper 74, 75 can be rolled out thus exposing the next row of adhesive cylinders 76 for the next installation/repair.

Along the back of the tapered channel can be a backstop vertical wall 30 extending upward with a narrow slot 35 across most of the bottom edge of the backstop wall 30 for allowing the tape end 74, 75 to be dispersed therethrough. The tape can be pre-rolled onto a collector roll 78 that is supported by a spool rotatably supported by an axle spool supports 40.

Figure 7:
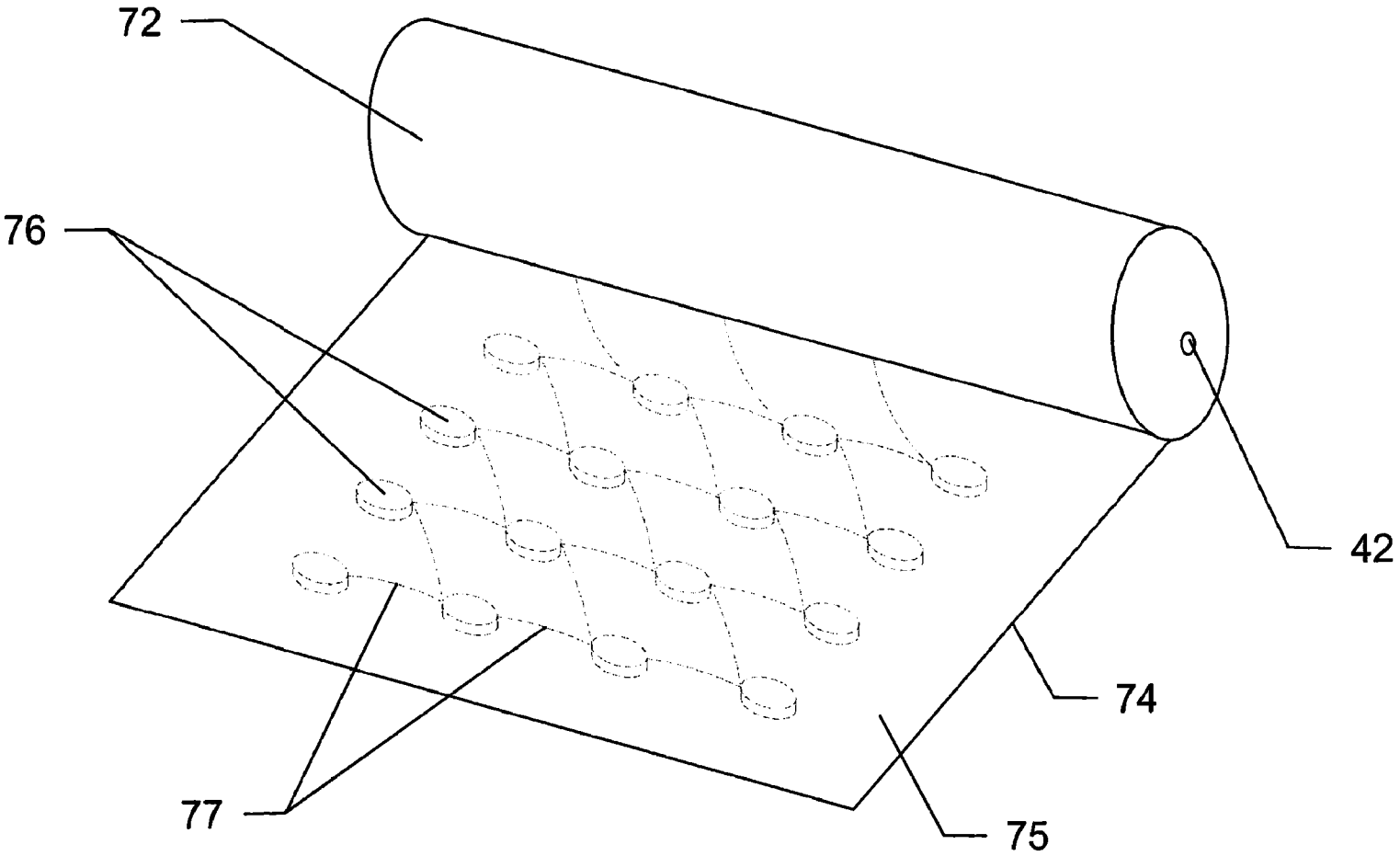
FIG. 7 is a perspective view of the tape roll that can be used with the device of FIG. 4.

FIG. 7 is a perspective view of the tape roll 72 that can be used with the device 10 of FIG. 4. The roll 72 can be formed from an elongated sheet having a length of approximately 10 ft to approximately 50 ft. The top layer is the paper coated with release adhesive, the dabs of adhesive are on top of the lower layer, and the fiber (plastic or wire mesh) 78 ties connect each adhesive dabs 76 which are used to hold the adhesive dabs 76 in place during the manufacturing process.

A sheet section can have an upper surface 75 with a plurality of rows of adhesive dabs 76, each dab 76 having a width of approximately 0.25 inches, a thickness of approximately 1/16 inch, and each dab 76 can be spaced apart from another by approximately 1 inch.

The inventors have defined at least five types of adhesive compounds that can be used for the adhesive dabs 76.

Option 1:
DOW—280A,282,7355,7358,7502,7657,Q2-7406,Q2-7566 and Q2-7735
General Electric—PSA 590,600,595,610,518,6574,529,750-D1,825-D1, 800-C
Purpose: Liquid adhesive dispensed onto tape
Properties: High viscosity, high cohesion and high adhesion up to 500 F.
Usable Life: Without admixtures approximately 9 months for DOW-Q2-7735 with a 24 month shelf life
Modifications: Extend useful life of adhesive to 10 to 15 years.
Option 2: Pre-adhesive silicone polymer
U.S. Pat. No. 8,524,836/Date: Sep. 3, 2013/Applicant: 3M
Purpose: Liquid adhesive dispensed onto tape-like substance.
Properties: Low O2 sensitivity, high peel strength, high cohesion, high temp. shear strength and room temperature application
Compatibility: Can be adhered to variety of materials including Kraft Paper and other type release papers as well as nylon and other fabric substances.
Modifications: Adhesive must have useful life of 10 to 15 years
Option 3:
USPTO: 20130075027/Date: Mar. 28, 2013/Applicant: 3M
Purpose: Adhesive with release liner on roll.
Functionality: Silicone based PSA compositions are coated onto a release liner, dried and then wound into roll.
Compatibility: Drywall, ceramic, glass, porcelain, wood and fiberglass
Usable Life: Testing performed on glass and drywall estimated at 30,000 minutes
Modifications: Determine compatibility with asphaltic products and laminate material.
Useful life must be 10-15 year range.
Option 4: Asphalt Roofing Cement
Companies: Tamko 801615, Henry 204, Wet-stick 202-1
Purpose: Known as plastic cement this compound is commonly used in roof repair.
Advantages: Self sealing, adhesive, and high ductility with 1/8 inch layer
Disadvantages: Low workability, it is putty like substance, log cure time, prone to blistering if too much adhesive applied
Modifications: Requires dispenser in controlled volume; must be limited spread; develop initial tackiness during cure period;
Option 5: Polymer-Modified Bitumens
As described in U.S. Pat. No. 5,085,701

Figure 8:
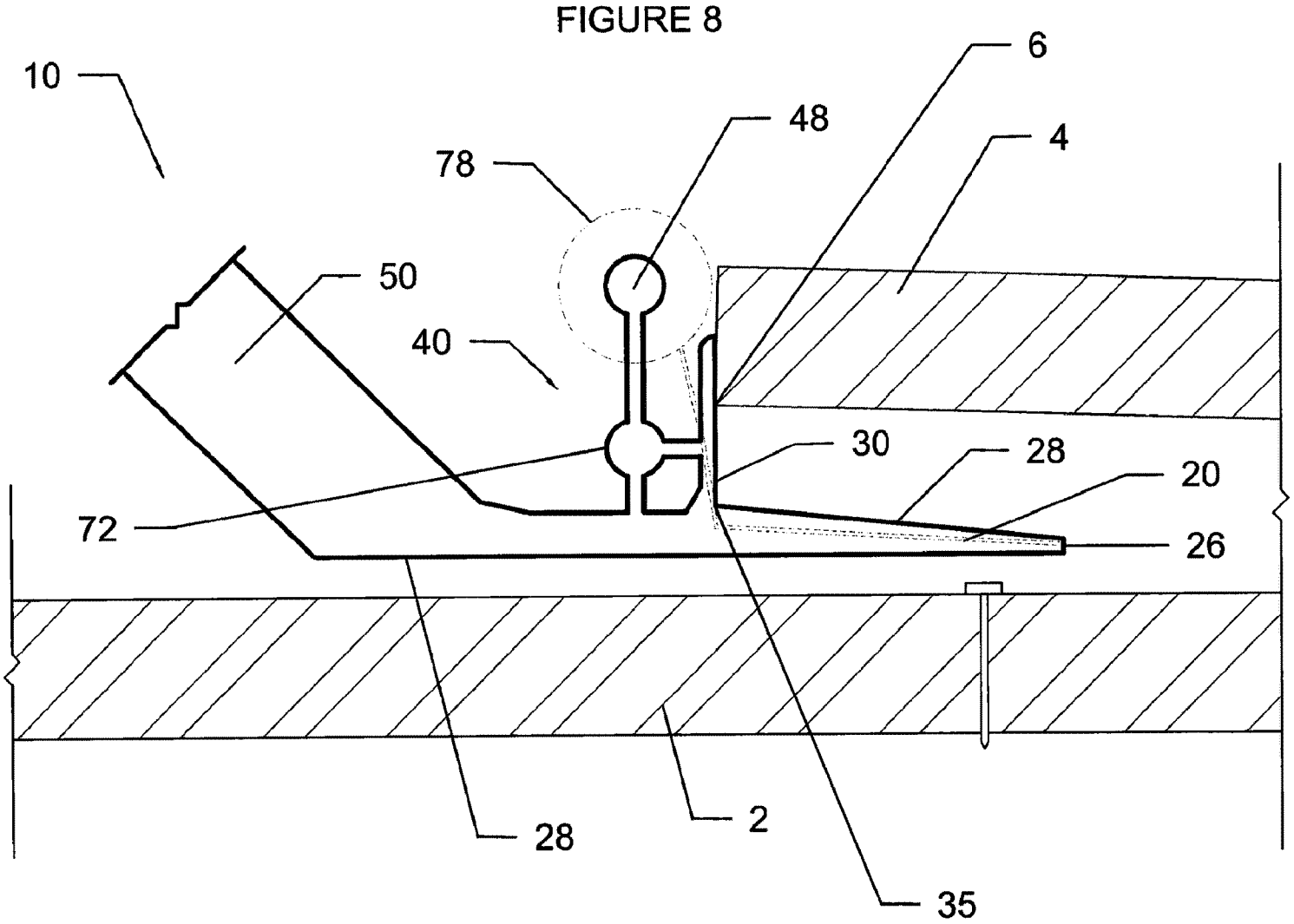
FIG. 8 is a side view of the device of FIG. 4 being used with a shingle.
Figure 9:
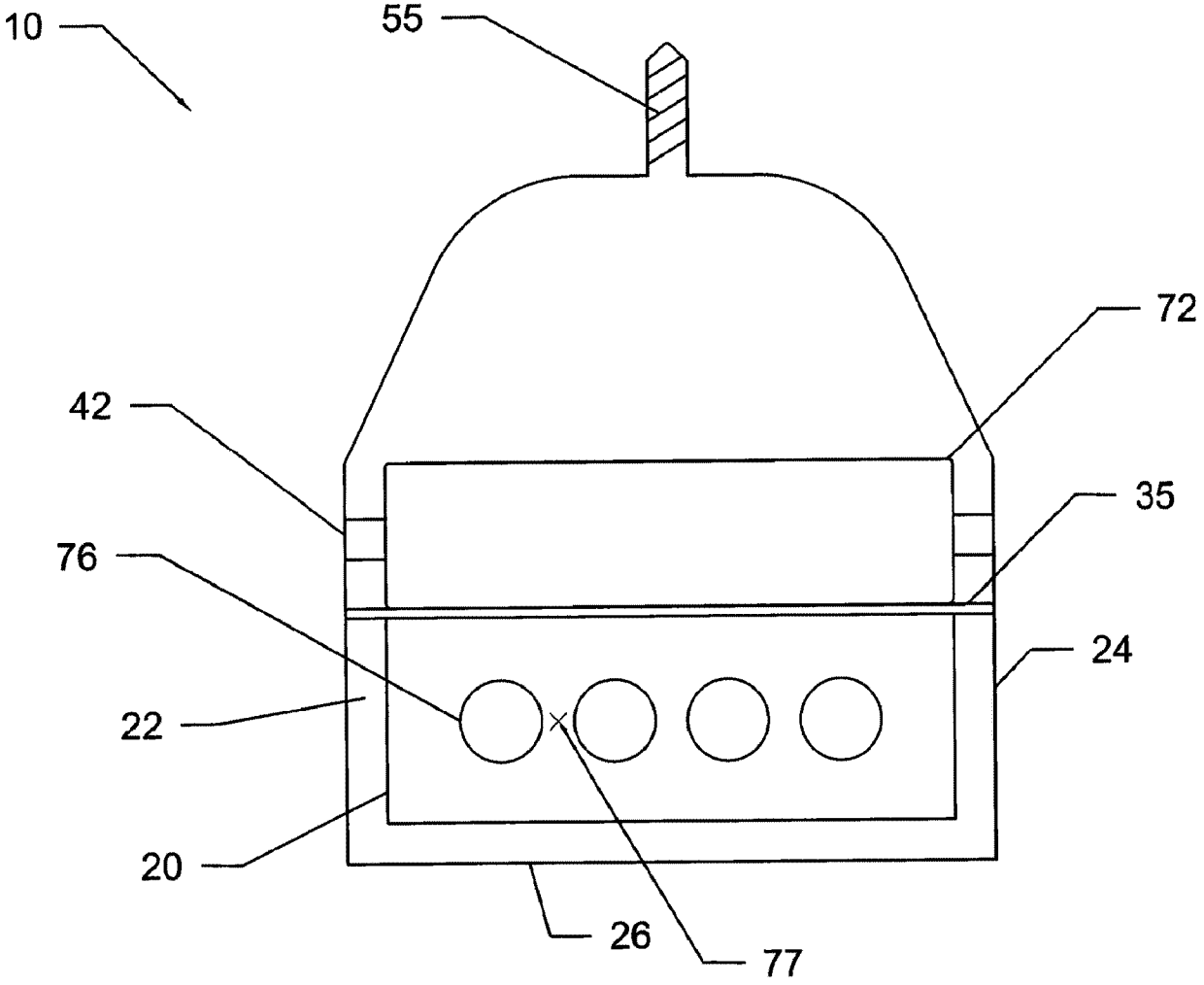
FIG. 9 is a top view of the device of the preceding figures with upper collector removed and showing approximate locations of the adhesive dabs.
Figure 10:
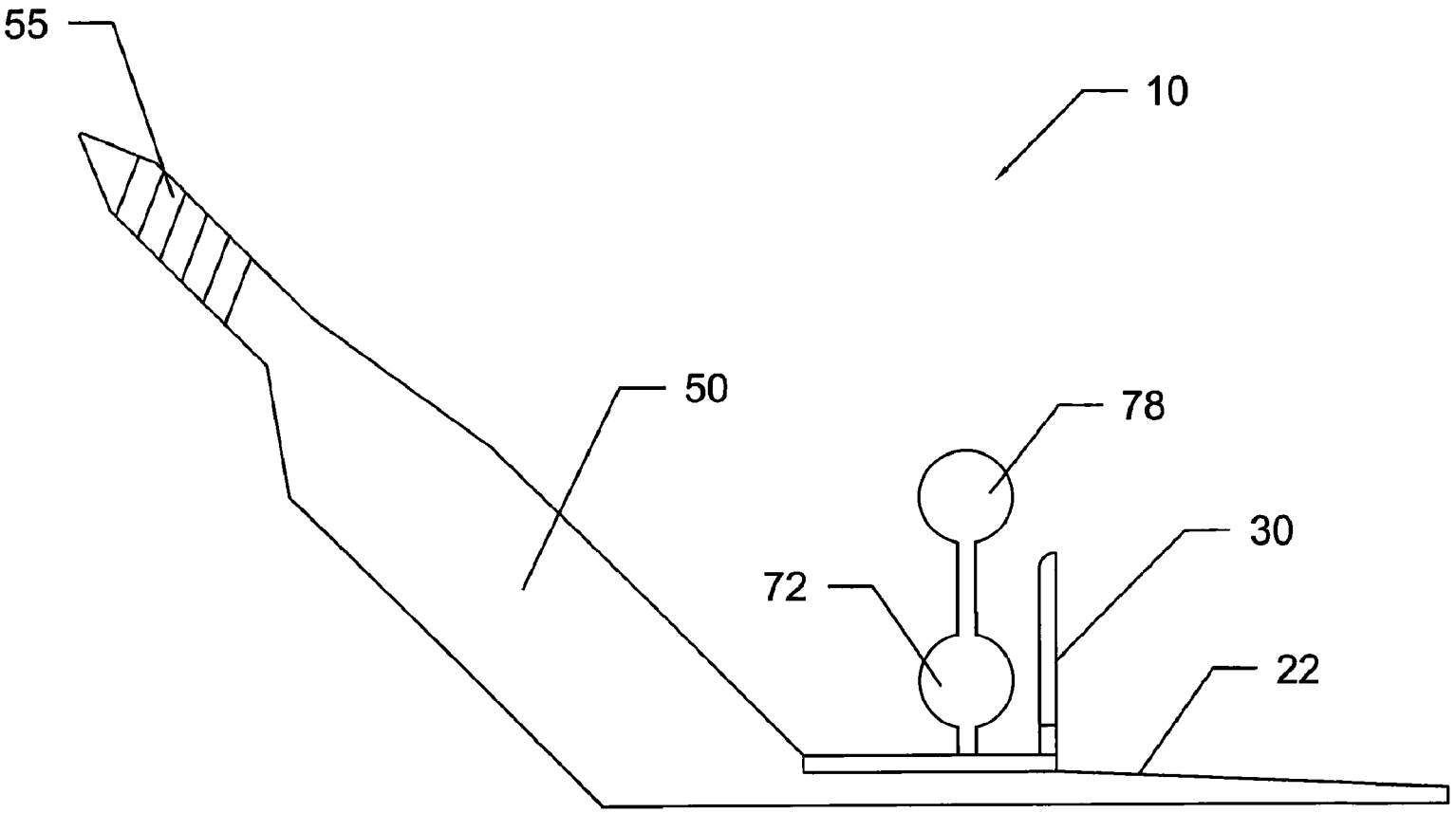
FIG. 10 is a side view of the device of FIG. 9.

FIG. 8 is a side view of the device 10 of FIG. 4 being used between layers of shingles 2, 4. FIG. 9 is a top view of the device 10 of the preceding figures with upper collector removed. FIG. 10 is a side view of the device 10 of FIG. 9.

Referring to FIGS. 4 to 10, the operation of the applicator device 10 will now be described. The device 10 can include a roll of tape 72 having adhesive dabs 76 thereon in a cylinder configuration on a lower spool 72, and an upper spool 78 for collecting the release paper into a roll, and compressed air canister (for cleaning surfaces before applying adhesive) which will be described below.

The tape roll 72 can include adhesive dabs 76 which are temporarily attached together using a loose mesh 77, such as but not limited to thin fiber ties and/or thin mesh wire. This array of cylindrically shaped dabs 76 can then placed onto the release paper 75 and rolled for storage. The release paper roll is how the adhesive tab cylinders 76 come to the site as a manufactured product. As each row of adhesive cylinders 76 is dispensed the release paper is rolled onto the upper empty spool such as a collector roll 78. FIG. 7 is placed upside down with the dabs 76 and mesh 78 faced down with the release paper 75 on top.

Mesh can be a loose breakable metal and/or plastic low strength material. The mesh is fragile to be able to break apart from hand pressure or when being pulled.

The installer can manually rotate the upper collector roll 78 to advance the dabs 76 with interconnected mesh 77 into the space between the shingles 2, 4. The upper roll 78 collects the release paper 74, 75 which allows the advancing of the mesh 77 connected dabs 76 to be within approximately one inch from the outer edge 6 of the upper shingle 4.

The mere action of merely physically pulling the tool device 10 out will break (sever) off a row of dabs 76 with mesh 77. The strength of the mesh 77 is designed to break under the minimum force it takes to remove the tool device 10 is withdrawn from between the shingles 2, 4. After the tool device 10 is removed, pressure is then placed on top of the upper shingle.

Next, the tool device 10 is moved to an adjacent location between upper and lower shingles, 2, 4, and the process of applying a next row of dabs 76 with mesh 77 placed is dispensed in a similar manner, followed by removing the tool device 10 and placing pressure again on top of the upper layer of shingles 2.

The adhesive can be applied either as a) controlled volume drops at uniform spacing and b) a polymeric cylinder dabs 76 of adhesive (approximately ¼ in. diameter, by approximately 1/16 in. tall, spaced approximately 1 inch apart and connected by mesh fibers 77 and attached to release paper. Option a) requires a storage volume in the applicator device.

A storage volume cylinder dispenser can alternatively be used to take the place of the lower release tape with dabs and mesh, which can be located just behind the backstop 30. The storage volume can be used instead of a paper roll 72. In operation, each dab 76 can be dispensed from an adhesive storage cylinder located behind the backstop, via capillary tubes that extend into the open space approximately 1 inch in a manner similar to the embodiment 100 shown and described in relation to FIGS. 11-18. The tubes can turn 90 degrees down to enable a drop of adhesive to be placed on the lower shingle 2 behind the front edge 6 of the upper shingle 4.

In both the paper roll version and the storage volume version, the worker pulls out the applicator device 10 before applying pressure on the upper shingle 4.

The shape and configuration of the device 10 was established to do the following results. The device 10 applies adhesive between shingle layers while minimizing the lifting of upper shingle 4. The device 10 can include a pressurized air source (not shown) which blows compressed air between shingles 2, 4, to remove loose dirt, aggregate or moss.

The device 10 precisely controls depth of installation of adhesive (from the leading edge) using the back stop 30 on the device 10 which can abut against the front edge 6 of the upper shingle 4. Using the device 10 per sections of shingles, an approximately 4 inches to approximately 6 inches wide upper shingle 4 can be sealed to a lower shingle 6 at a time. The process can be repeated along a row of shingles starting from one side of the roof section to another, and then up the next row of shingles and so on as needed.

A Chemtronics ES1015 Ultrajet 70 Duster can be used to remove dust, dirt and other dry contaminants from a variety of surfaces. The duster canister can be located in the rear of the device 10 and it has at least three tubes extending into the front open area of the device 10. It is anticipated the air pressure will produce a sharp uniform air source that would clear away any loose materials between the shingles 2, 4.

During operation, the release paper from lower roll 72 is advanced by winding it onto upper roll—this moves the row of adhesive dabs 76 into place. Next the device 10 can be inserted by gently pushing the outer blade edge 26 of the channel 20 between shingles 2, 4 until the back stop 30 just touches the upper shingle's lead edge 6. Next the worker can apply hand pressure to the top surface of upper shingle 4. Hand pressure can be applied for approximately 3 to approximately 5 seconds as the device 10 is lowly withdrawn, breaking the fiber ties 77 between the subsequent lines of fibers. Then a steel roller (not shown) can used on top of the upper shingle 4 to mate the two surfaces between shingles 2, 4 and the adhesive dabs 76 together. This roller can be applied for approximately 10 to approximately 20 seconds with hand pressure.

The device 10 can be withdrawn from between the shingles 2, 4 taking the release paper with it, and leaving the adhesive cylinder dabs 76 and broken fiber ties in place. Then the release paper is advanced by rolling the paper onto the upper collector roll 78, advancing the cylinder of the tape roll 72 by a set distance. The device 10 can then moved onto the next shingle joint. The release paper enables the adhesive dabs 76 to advance into the opening prior to dispensing by rolling the upper spool 48 retrieving the release paper. When the applicator tool device 10 is removed the paper is also removed. The cylinder roll 72 of adhesive are advanced by rolling out the release paper.

The elongated handle 60 can ensure an ergonomic work arrangement. In operation, the worker can be in a kneeling position on one knee and gently pushes the device into the groove between the shingles with the second knee.

The novel lightweight handheld device 10 can provide a consistent sealing tab for installation between two roof shingles 2, 4 laid out on a roof. The novel device 10 can become an essential tool for professional roofers during inspection of an asphalt shingle roof.

The device 10, system and method of use and application can be used in new roof installations, during pre-hurricane inspection and repair for asphalt shingles that can include a new niche among roofer to gutter cleaning, repair of shingle tab seals and inspection of penetrations, and be made to be part of a franchise operation.

Figure 11:
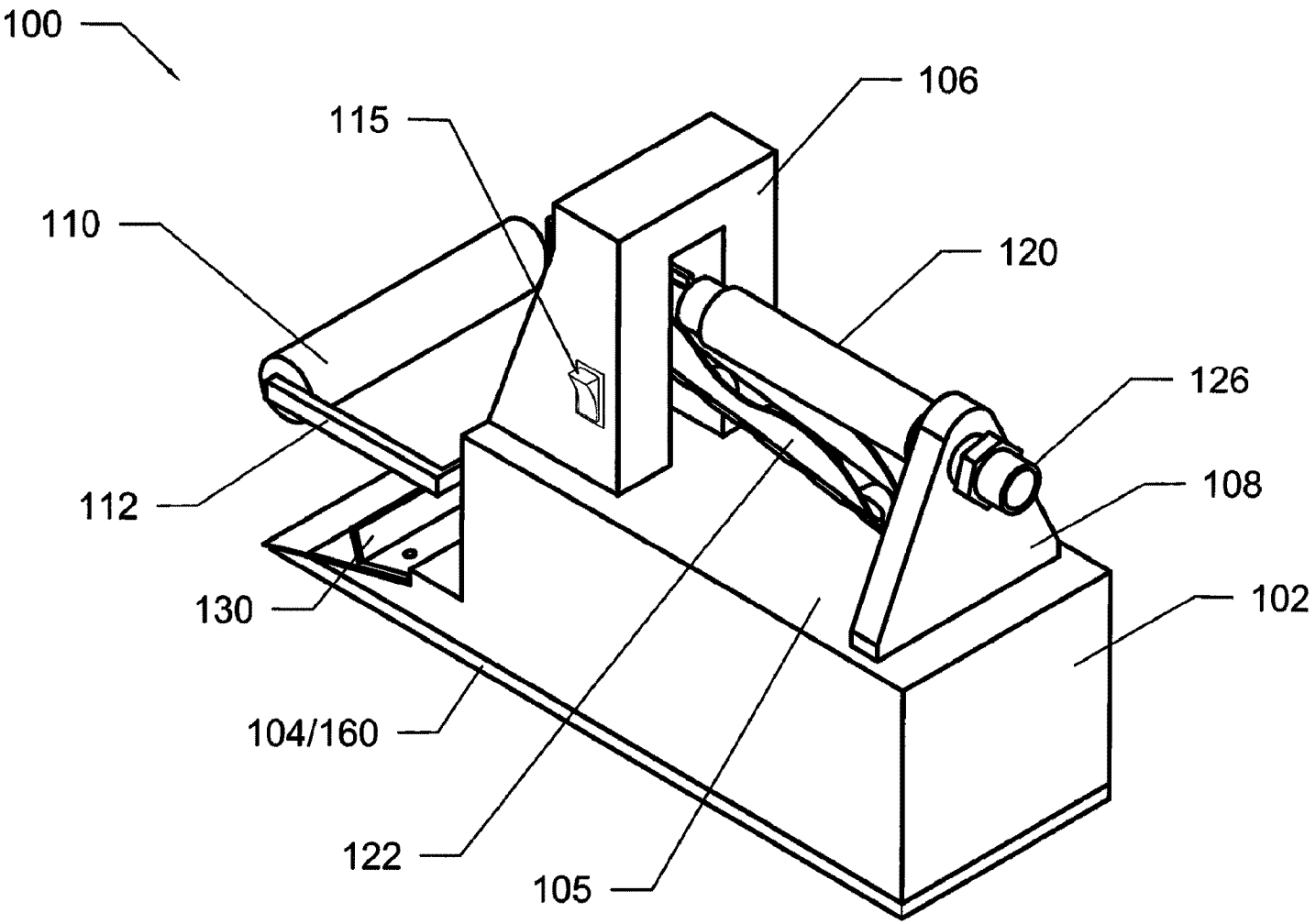
FIG. 11 is an upper rear side perspective view of a handheld shingle repair device embodiment with metal channels for dispensing adhesive.
Figure 12A:
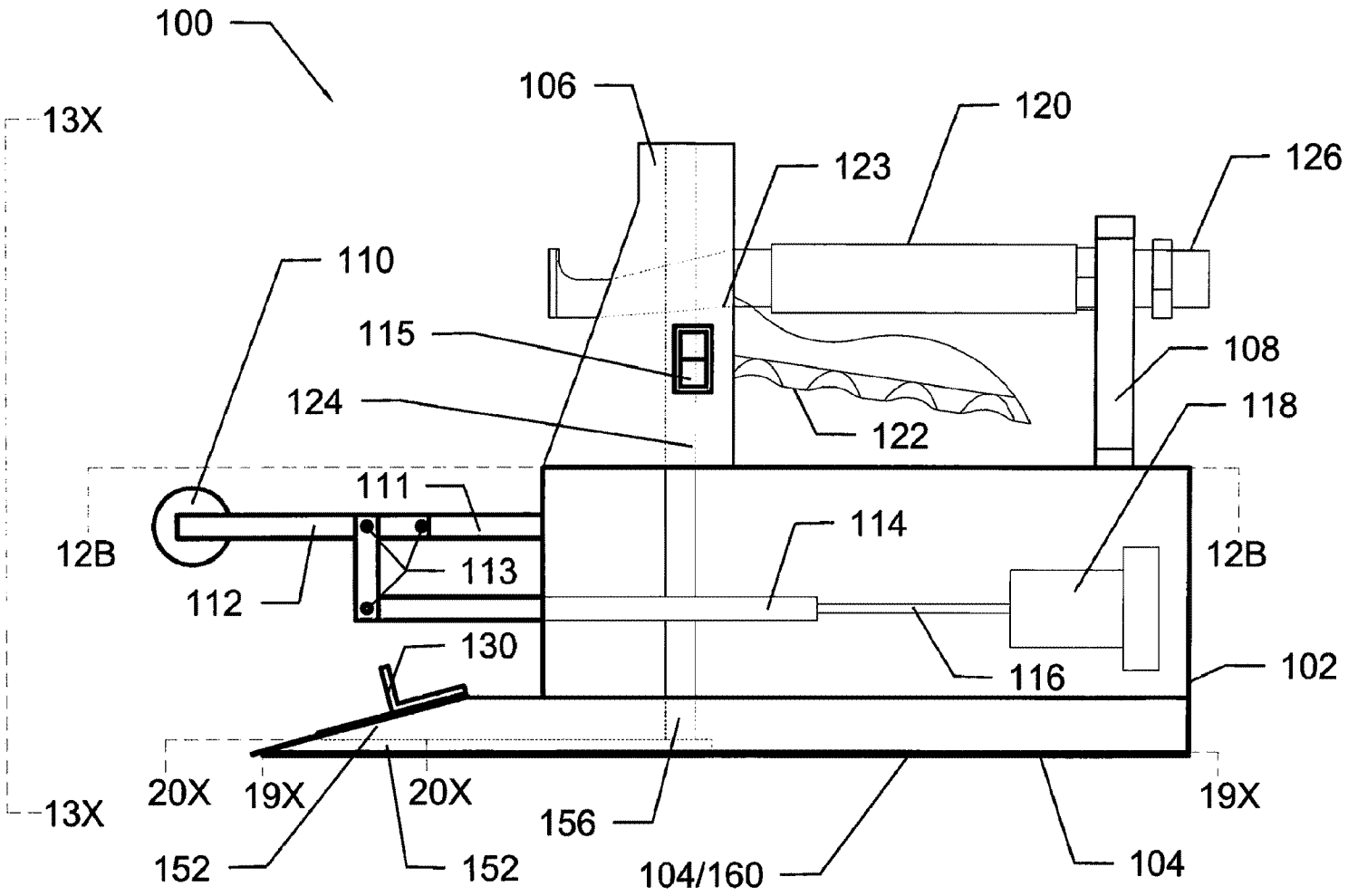
FIG. 12A is a side view of the handheld shingle repair device of FIG. 11.
Figure 12B:
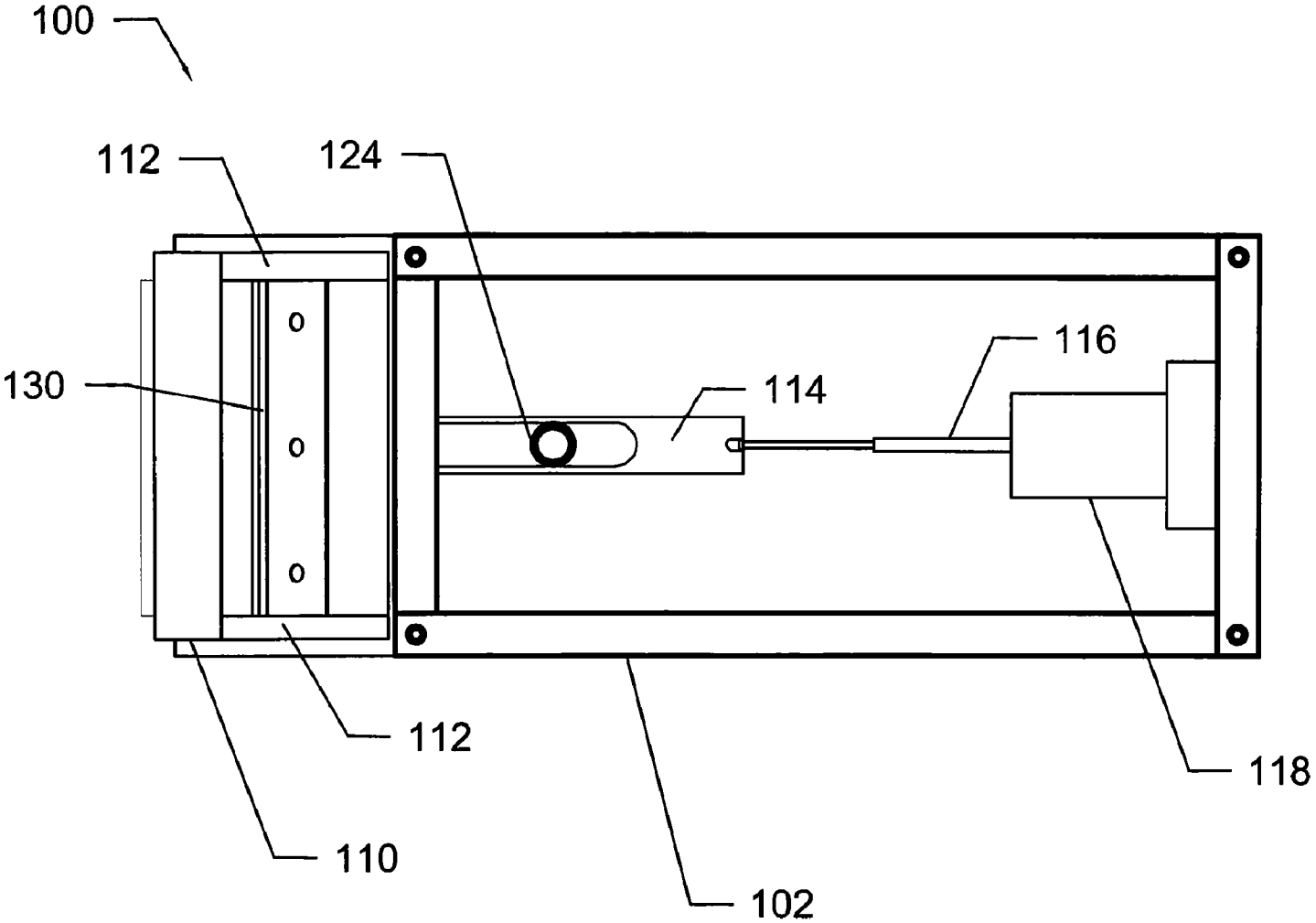
FIG. 12B is a cross-sectional view of the repair device of FIG. 12A along arrows 12B.
Figure 13:
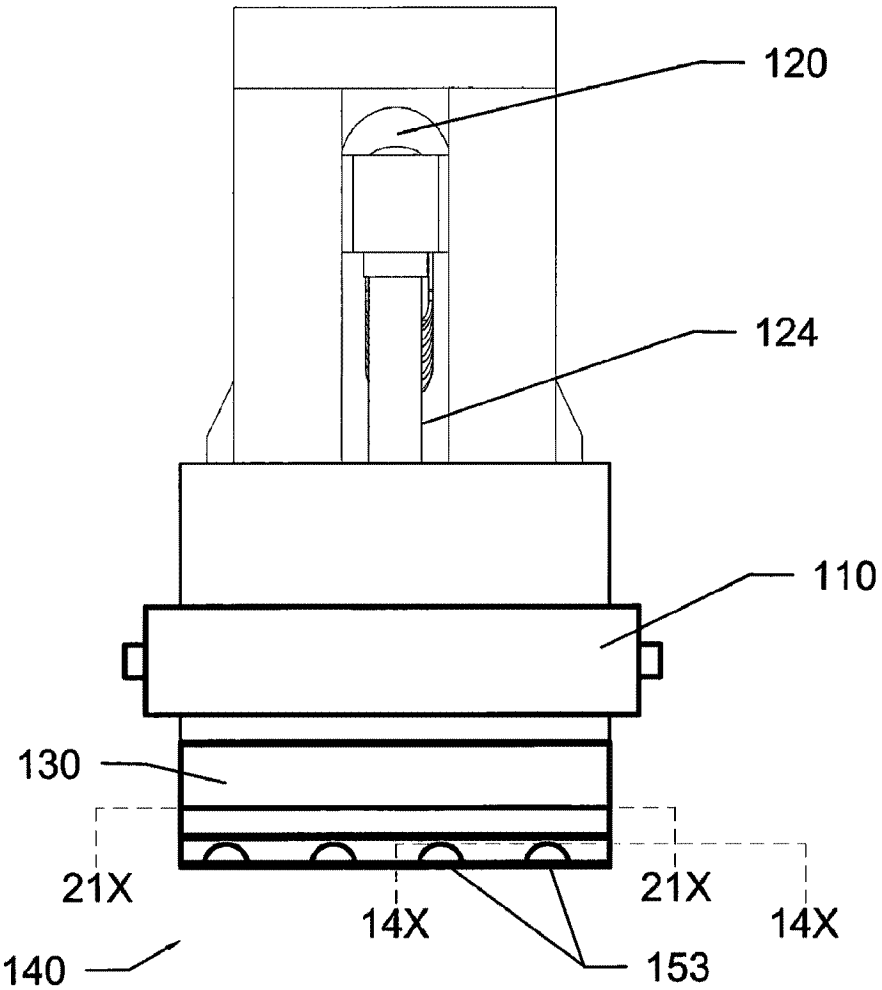
FIG. 13 is a front end view of the shingle repair device of FIG. 12A along arrow 13X.
Figure 14:
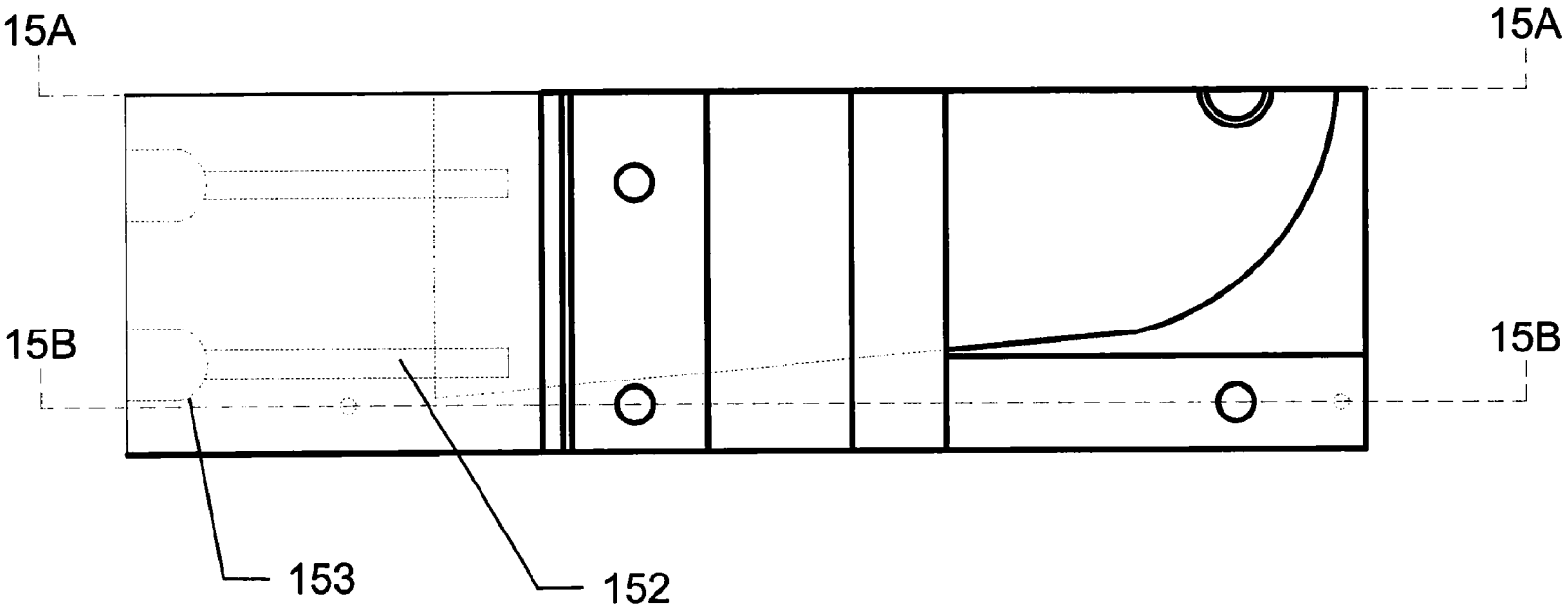
FIG. 14 is a partial top cross-sectional view of the shingle repair device of FIG. 13 along arrows 14X.
Figure 15A:
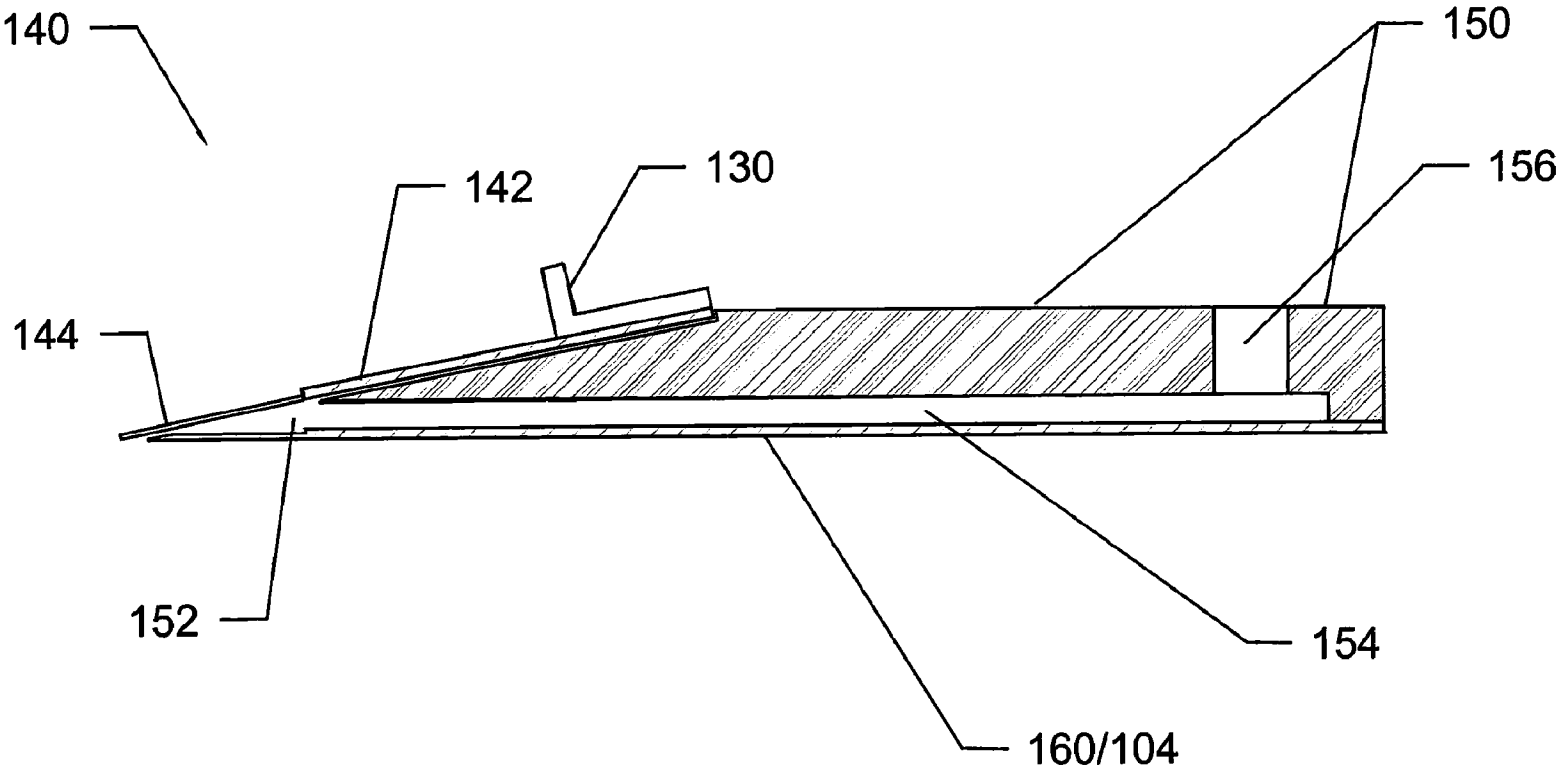
FIG. 15A is a cross-sectional side view of the view of FIG. 14 along arrows 15A.
Figure 15B:
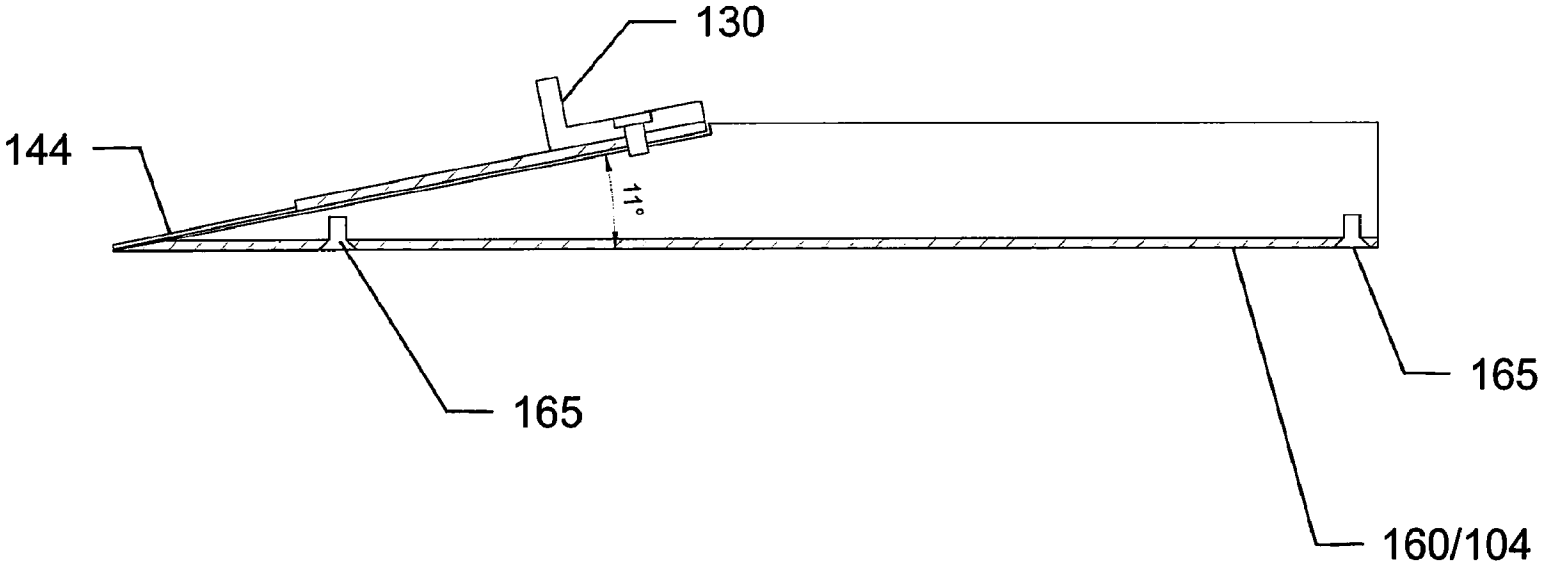
FIG. 15B is a cross-sectional side view of the view of FIG. 14 along arrows 15B.

FIG. 11 is an upper rear side perspective view of a handheld shingle repair device 100 embodiment with metal channels 152 (shown in FIGS. 12A, 14) for dispensing adhesive. FIG. 12A is a side view of the handheld shingle repair device 100 of FIG. 11. FIG. 12B is a cross-sectional view of the repair device 100 of FIG. 12A along arrows 12A. FIG. 13 is a front end view of the shingle repair device of FIG. 12A along arrow 13X. FIG. 14 is a partial top cross-sectional view of the shingle repair device 100 of FIG. 13 along arrows 14X. FIG. 15A is a cross-sectional side view of the view of FIG. 14 along arrows 15A. FIG. 15B is a cross-sectional side view of the view of FIG. 14 along arrows 15B.

Figure 16:
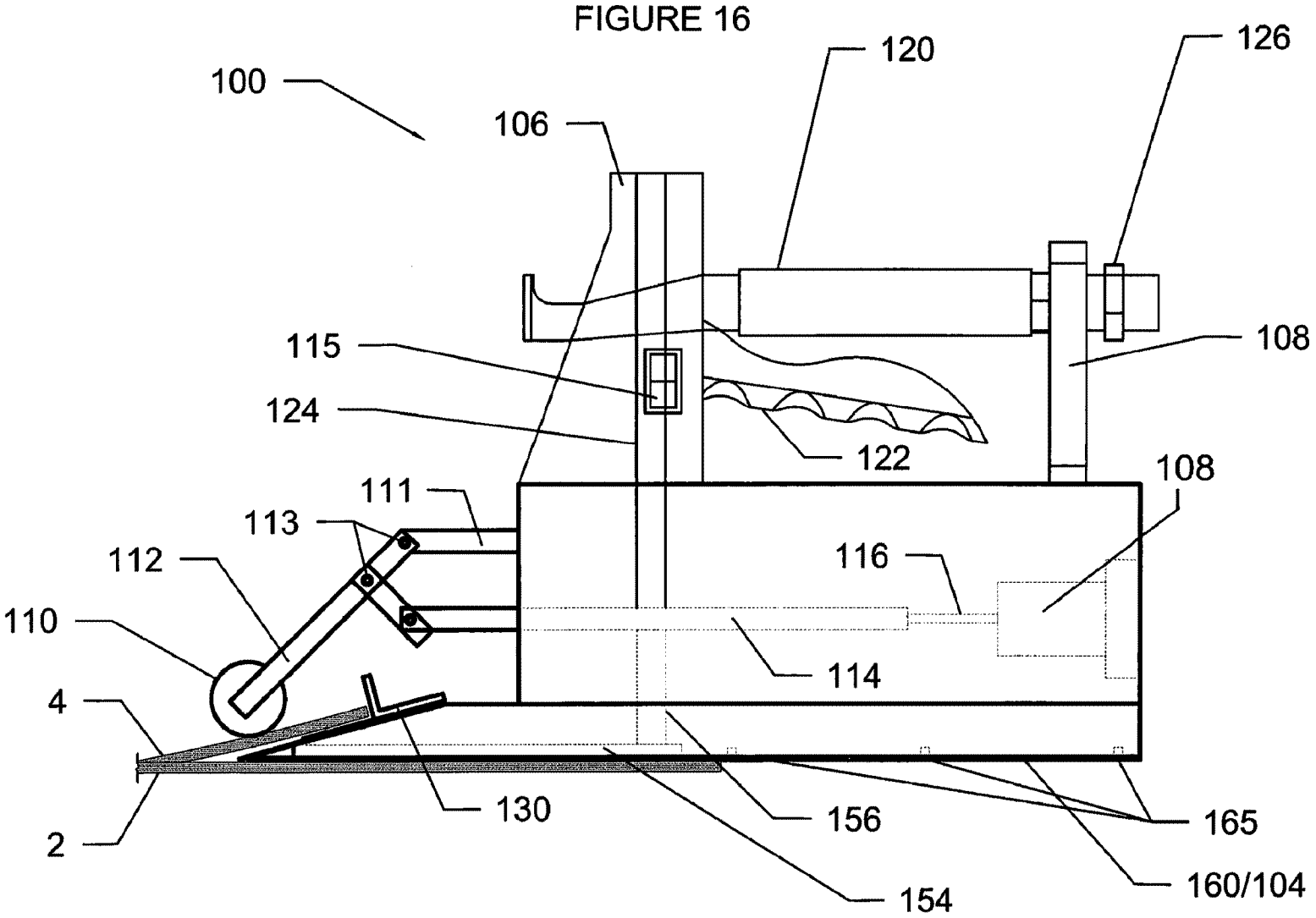
FIG. 16 is a side view of the shingle repair device of the preceding figures being used in a repair between roof shingles.
Figure 17:
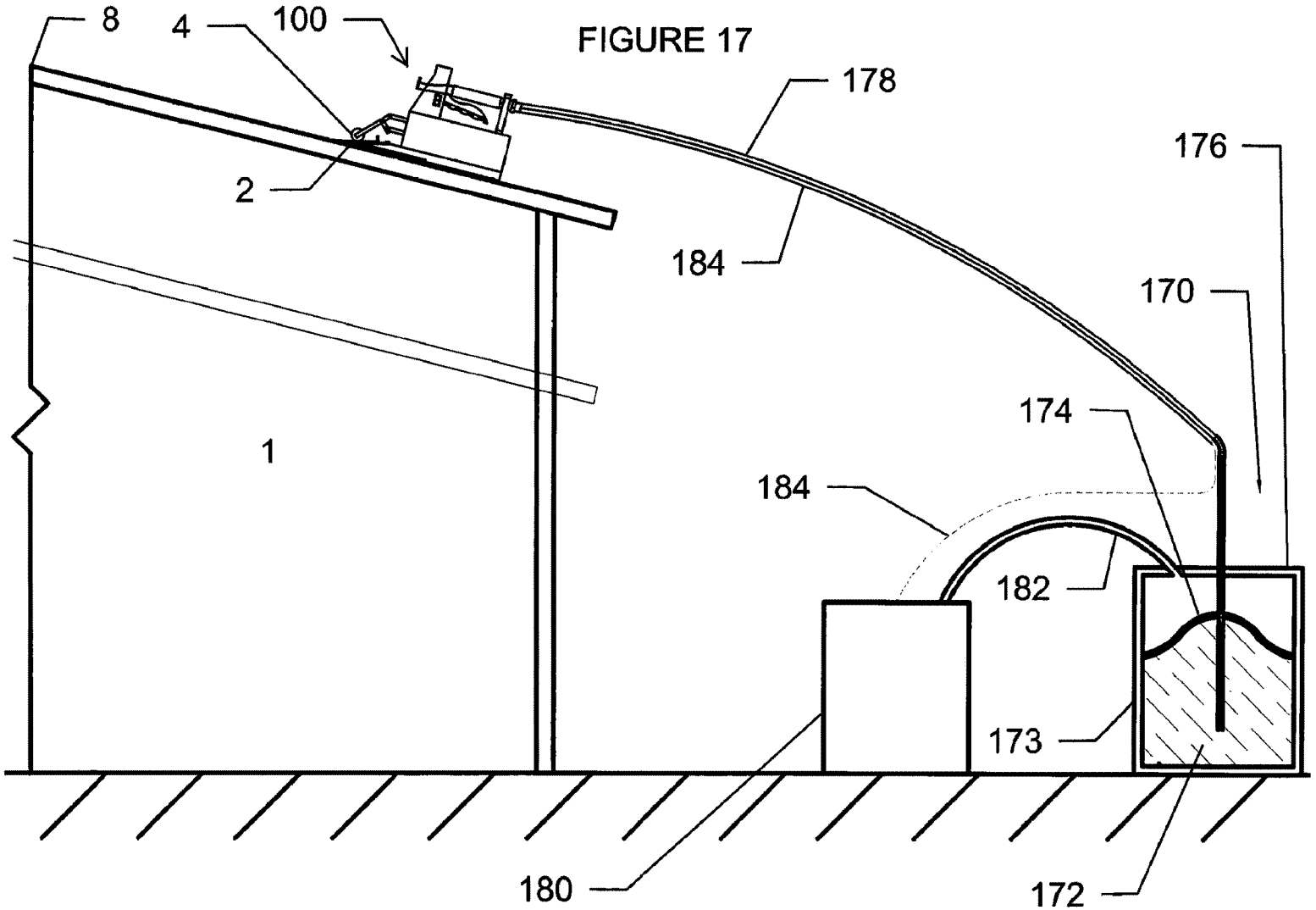
FIG. 17 is another view of the shingle repair device of FIGS. 11-16 being used on a roof along with other components.

FIG. 16 is a side view of the shingle repair device 100 of the preceding figures being used in a repair between roof shingles 2, 4. FIG. 17 is another view of the shingle repair device 100 of FIGS. 11-16 being used on a roof 8 on a building/house 1 along with other components 170-184

Referring to FIGS. 11-17, the shingle repair device 100 can be a handheld device which can have a weight of up to approximately 20 pounds having a general size such as other tools used in the trades such as a circular saw, and the like.

The tool device 100 can have dimensions of approximately 4 inches wide, by approximately 5 inches high, by approximately 10 to approximately 12 inches long.

The device 100 can have a box like configuration main housing 102 with a front lift end 140 and air actuated pressure roller 110. The top of the device 100 can have a generally cylindrical hollow handle 120 with an inner tube that runs through for delivering pressurized adhesive 172 from a source 170 shown in FIG. 7.

The lift end 140 has three metal layers, an angled steel lift 142, having a sloped pitch angle of approximately 11 degrees to the horizontal, with a steel shoe 160 having a plurality of machined channels (for dispensing the adhesive), with an aluminum plate 150 between the steel lift 142 and steel shoe 160.

The tip 144 of the angled steel lift 142 can be tapered to a thin edge, having a thin plate 144 (similar to a putty knife). The thin plate edge 144 can be approximately 1/32 inch to approximately 1/16 of an inch thick, having a flat plate with a tip width of approximately 4 inches by approximately 2 to approximately 4 inch depth. Four curved cut-outs 153 in the front tip edge 144 can each be approximately ½ inch wide by approximately 0.7 inches, and the cut-outs 153 can be spaced approximately 1 inch apart (center to center).

The steel shoe 160 can be a steel base plate 104 of approximately ⅛ of an inch to approximately ¼ of an inch thick, which can be removable for servicing inside of the device 100. The back of the steel plate 160/104 can have fasteners 165 such as screws that screws the base plate 160/104 to the aluminum plate 150.

The lift end 140 can have a narrow tip 144 that is configured to insert between two installed shingles 2, 4 without causing stress to the shingles 2, 4 that could result in breakage. In addition the tip 144 will space the adhesive along an approximately 4 inch width of the shingles 2, 4.

In a typical shingle(s) 2, 4 having a width of approximately 36 inches, there can be an unsealed portion having a width of up to approximately 12 to approximately 16 inches. For this unsealed portion the lift end 140 of the tool device 100 is placed along one side edge to put the adhesive dabs up to approximately 4 inches in from one side edge of the shingle. Followed by moving the device 100 to the opposite side edge of the shingle to put the adhesive dabs down, so that approximately both 4 inch side edges of the partially unsealed section of the shingle The steel shoe 160/104 can have a plurality of channels 152 (preferably four channels) with cut-outs 153 for dispensing dabs of the adhesive therefrom.

The channels 152 can be machined in the outer end of the steel base plate 160/104 and can have a rectangular configuration.

The channels 152 can be tapered which follows the approximately 11 degree sloped pitch of the steel lift plate 142.

Each of the channels 152 can be approximately 0.03 inches high by approximately 0.06 inches wide, and spaced apart approximately 1 inch between centers of each channel 152.

Once the outer edge of the shingle abuts against the guide stop 130, the dispensing end (cut-outs 153) of the channels 152 is in an optimum position.

A pivotable pull trigger 122 having a pivoting hinge 123 underneath the top handle 120 when squeezed will dispense a selected specified volume amount of adhesive 172 in a puddle of approximately ¼ inch in diameter (less than a few ounces) through the outer ends 153 of the channels 152 in the spaces between the shingles 2, 4. The pull trigger 120 can also be spring biased to go back to an extended position after being squeezed.

In a preferred embodiment, the adhesive can be purchased in a liquid form in a standard metal 5 gallon containers 152 (such as the BLACK JACK® RUBR SEAL by Gardner-Gibson Inc., Tampa, Fla.) described below.

A standard electric or gas powered air compressor 180 can be attached to both the roller assembly (roller 110, 111, 112, 113, 114, 116, 118), and to the 5 gallon container 173, such as a pail, holding the stored adhesive 172.

The top of the container 173 can include a flexible rubber disk 174 (similar to a diaphragm) that pushes down onto the liquid adhesive 172 in the container 173 keeping it under pressure (of approximately 50 to approximately 150 PSI (pounds per square inch) so that the adhesive is forced up through a delivery tube 178, such as but not limited to a Teflon/solvent resistant delivery tube system to pass into the hollow conduit tube 126 in the tool device handle 120. Approximately 80 cubic inches per minute can be delivered with this compressor 180 which uses an air-line 182 to pass pressurized air into the container 173 having the diaphragm/disk 174 and adhesive 172.

A valve normally in a closed position inside the tubular handle 120 can be opened when the trigger 122 is squeezed. The tool handle 120 with pivoting trigger 122 can be supported between a front stand 106 and rear stand 108 extending upward from the housing 102. Squeezing the trigger 120 will allow only a selected amount of adhesive 172 to pass through the hollow tubular handle 120 and into a vertical adhesive reservoir and delivery chamber 124, which connects by an input line 156 to a horizontal pre-application chamber 154 for the adhesive under pressure. The pressure in the vertical delivery chamber 124 and horizontal pre-application chamber 154 will cause the puddle of adhesive to squirt out the cut-out ends 153 of the channels 152 in the selected locations between the shingles 2, 4.

Alternatively, a pump, such as a hydraulic pump can be located on top of the container 173 between the air compressor 180 and the air activated rubber disk 174. One type of pump that can be used can be a Lincoln High-Pressure, Portable, Heavy-Duty Grease Pumps Model 9989 50:1-25-, 50-lb. Portable with Pail Cover.

Lincoln High-Pressure, Portable, Heavy-Duty Grease Pump, Model 9989 50:1, http://www.lincolnindustrial.com/Catalogs/_English/00-MAIN_Catalogs/LubeToolsEquip.pdf The air supply line 182 from the air compressor 180 with regulator can insert into another connector. There is an air transfer orifice under the pump that pushes on a large diameter disk 174 that forces the fluid (adhesive) into the air operated high pressure delivery pump then out the high pressure hose 178 to the application handle 120. In a preferred application, a maximum 80 cubic inches per minute at 150 psi. This delivery volume can be regulated down by reducing the input air pressure with the regulator at the air compressor 180. If more volume is needed, larger pumps are available.

The operator can place the tool device 100 running along a row of shingles, and use finger pressure to identify shingles that have become partially unsealed. Once the partially unsealed shingle is found, the tool device is placed between the shingles up to the shingle edge just touching the guide stop.

After dispensing the adhesive, the lifting end 140 of the tool device 100 can be backed out so the lifting tip 144 is just outside the outer edge of the shingle.

In operation, the worker pulls out the applicator device 100 as the roller 110 is deployed applying pressure on the upper shingle.

Next, an air actuated pressure roller 110 can be activated by a switch 115, which when activated will cause the roller 110 to be depressed and push down on the top shingle bringing the two shingles 2, 4 into intimate contact, and enabling the adhesive to wet both shingles (underside of top shingle and top side of lower shingle) to cause a good surface contact. The roller 110 can come down with some force of approximately 1 to approximately 6 pounds, and held in the down depressed position for between approximately 5 to approximately 20 seconds.

The air cylinder 118 with regulator inside the tool device 100 can be connected to an external air compressor 180 by an air hose 184 A switch 115, such as but not limited to a toggle switch, and the like, activates a regulator can be adjacent to the handle 120 which when activated releases air from the compressor 180 which passes through the hose 184. Pressurized air is delivered into the air cylinder 118 with regulator which activates the piston 116, which moves the retractable arm 114 which causes parallel control arms 112 supporting the roller 110 to move downward by pivot points 113 relative to main support 111 to depress the roller against the top of the upper shingle. The switch can be timed to release or be manually released after approximately 5 to approximately 20 seconds.

FIG. 18 is a table of a preferred adhesive for use with the repair device of the preceding figures.

A preferred adhesive can be the BLACK JACK® RUBR SEAL by Gardner-Gibson Inc., Tampa, Fla. Other adhesives can be used, as long as they have a useful life of at least approximately 10 to approximately 15 years.

The lifespan of many shingle roofs, such as those in Florida can have a lifespan of approximately 20 years. The tool device 100 can be targeted to be used when the roof is approximately 5 to approximately 6 years old, so that the tool device 100 can extend the roof lifespan to the 20 year life of the shingles.

The shape of the device 100 was established to produce the following results. The device 100 applies adhesive between shingle layers while minimizing the lifting of shingle.

The tool device 100 can be used with some loose dirt or loose granules between the shingles. The puddles of adhesive can have wet ability properties to wet all the dirt and granules and the opposing surfaces of the shingles to create a monolithic layer all around the dirt and granules locking the granules and dirt in place in the adhesive layer formed between the shingles.

Optionally, the tool device 100 can incorporate dispensing a jet of compressed air between shingles to remove loose dirt, aggregate or moss. The tool device can be incorporated with an optional Chemtronics ES1015 Ultrajet 70 Duster which can remove dust, dirt and other dry contaminants from a variety of surfaces. The duster canister can be located in the rear of the device and it has one or two tubes extending into the front open area of the device to shoot a fan-like spread of compressed air clearing away the loose granules and dust. It is anticipated the air pressure will produce a sharp uniform air source that would clear away any loose materials between the shingles.

Optionally, the tool device can be used without the pivotable roller 110, where a hand-controlled separate roller can be applied for 3 to 5 seconds as the tool is slowly withdrawn. Followed by, approximately 10 to approximately 20 seconds with hand pressure after the tool device is withdrawn.

After one application, the device 100 is then moved onto the next shingle joint, and the operation continued from shingle to shingle.

The novel lightweight handheld 100 device can provide a consistent sealing tab for installation between two roof shingles laid out on a roof. The novel device can become an essential tool for professional roofers during repair and maintenance of an asphalt shingle roof.

The device, system and method can be used in new roof installations, during pre-hurricane inspection and repair for asphalt shingles that can include a new niche market among roofer to gutter cleaning, repair of shingle tab seals and inspection of penetrations, and be made to be part of a franchise operation.

Figure 19:
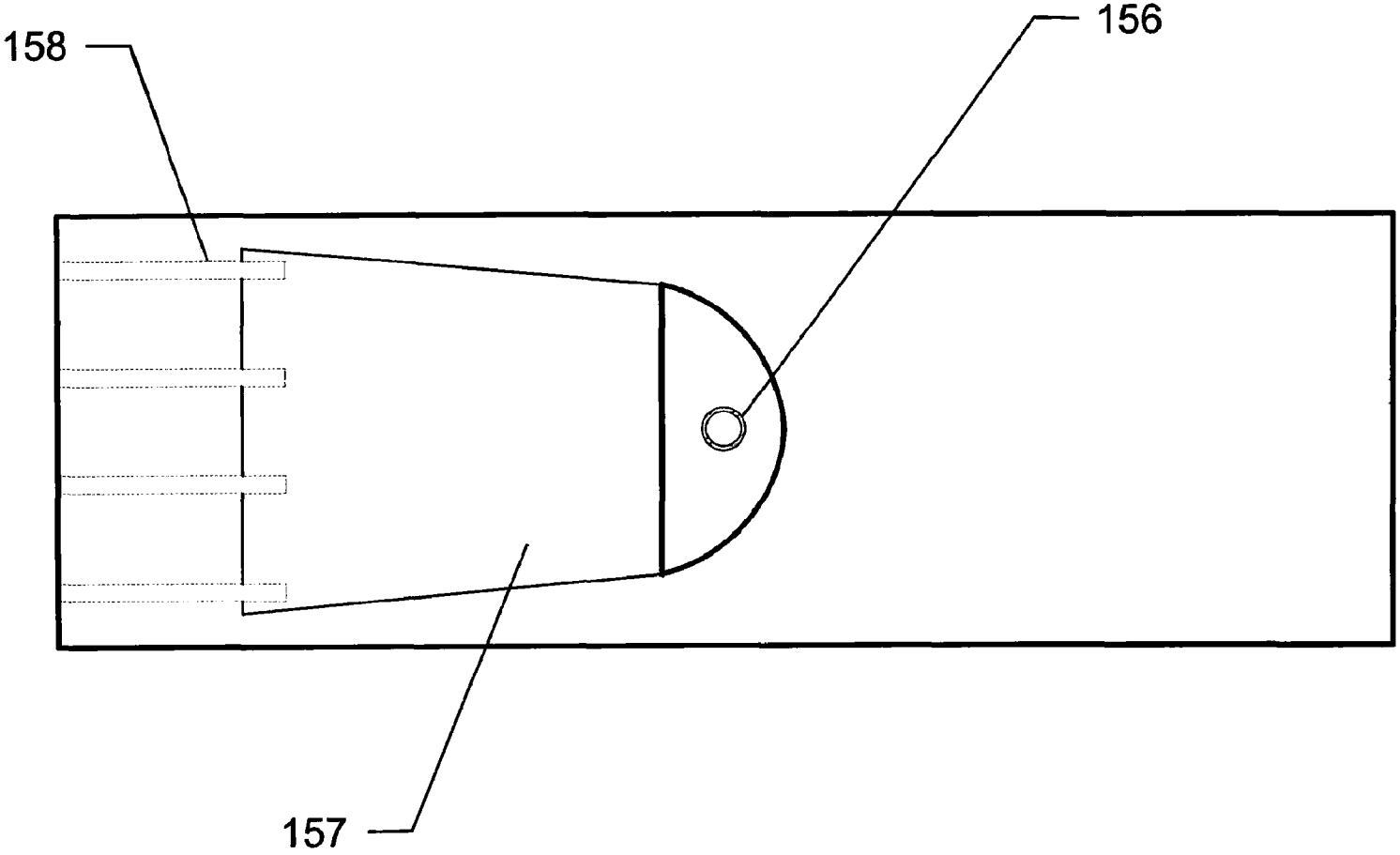
FIG. 19 is a top view of another embodiment of the shingle repair device of FIGS. 11-17 using replaceable adhesive application tubes.
Figure 20:
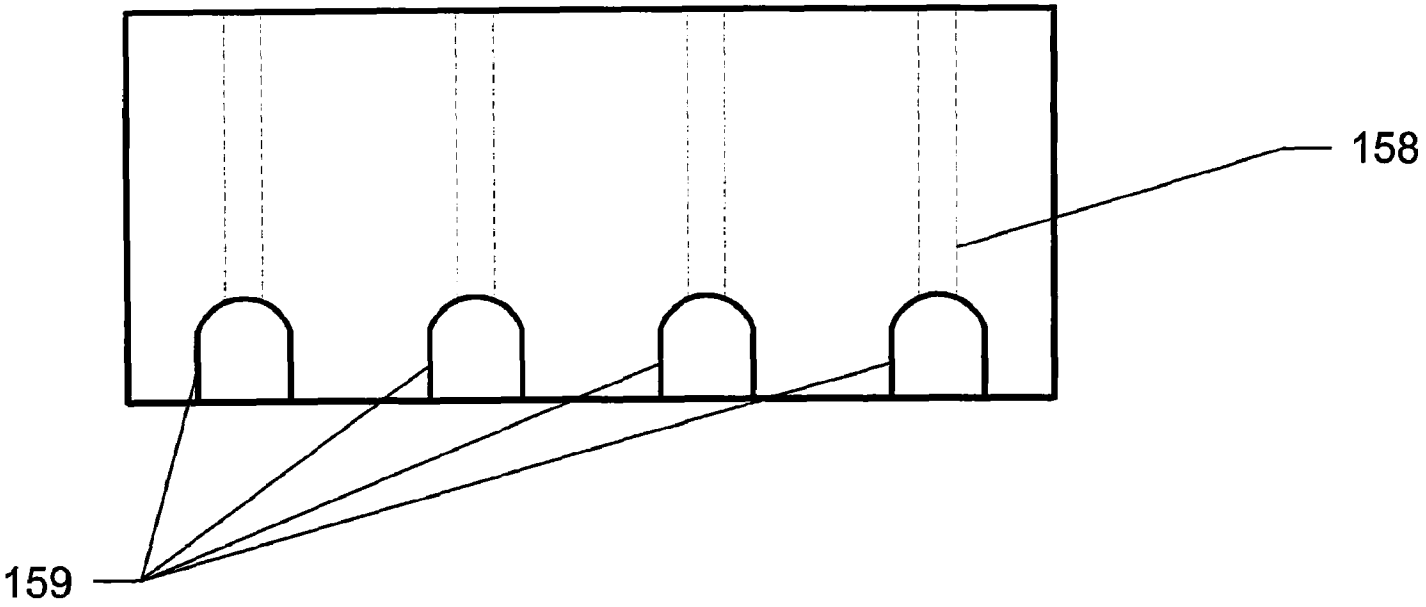
FIG. 20 is an enlarged top view of the lift end with application tubes of the shingle repair device of FIG. 19.
Figure 21:
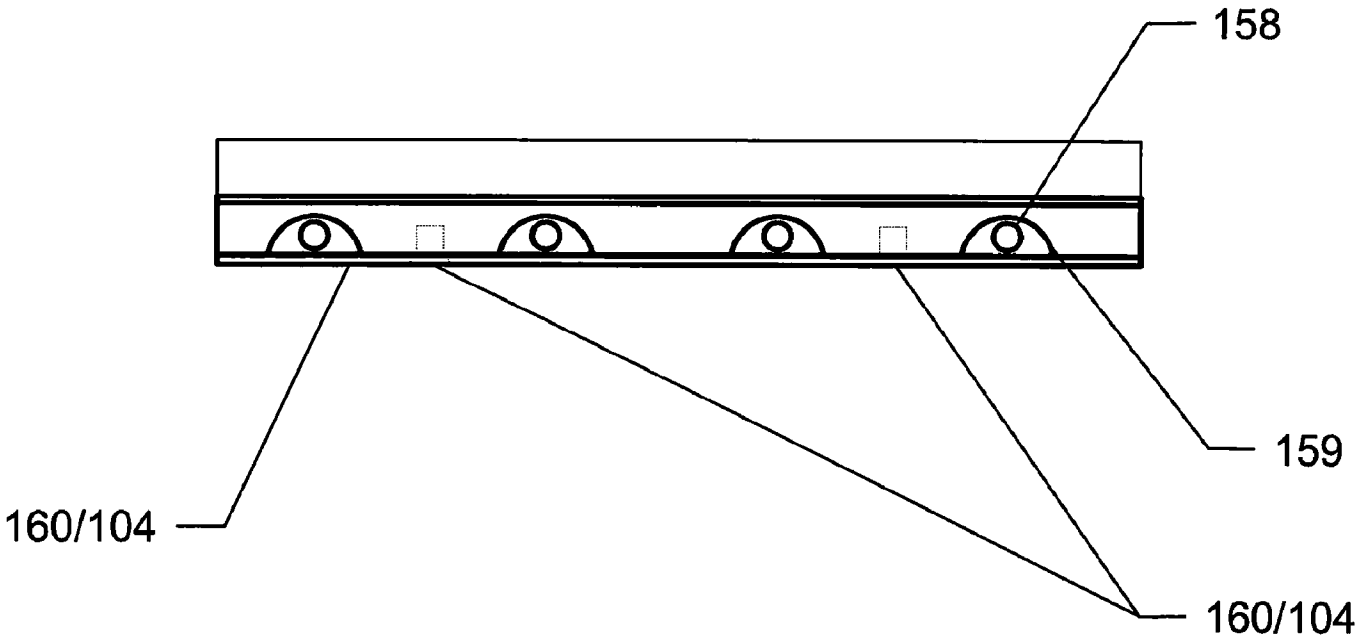
FIG. 21 is a front end view of the lift end of the shingle repair device of FIG. 10.

FIG. 19 is a top view of another embodiment of the shingle repair device 100 of FIGS. 11-17 using replaceable adhesive application tubes 158. FIG. 20 is an enlarged top view of the lift end 140 with application tubes 158 of the shingle repair device 100 of FIG. 19. FIG. 21 is a front end view of the lift end 140 of the shingle repair device 100 of FIG. 10.

Referring to FIGS. 19-21, this device embodiment works similar to the previous embodiment, and substitutes replaceable adhesive application tubes 158, such as Teflon tubes, and the like, for the grooved out metal channels 152, and operates similarly to the previous embodiment and dispenses adhesive though lift noses 159 which can be tapered for insertion between shingles 2, 4.

Figure 22:
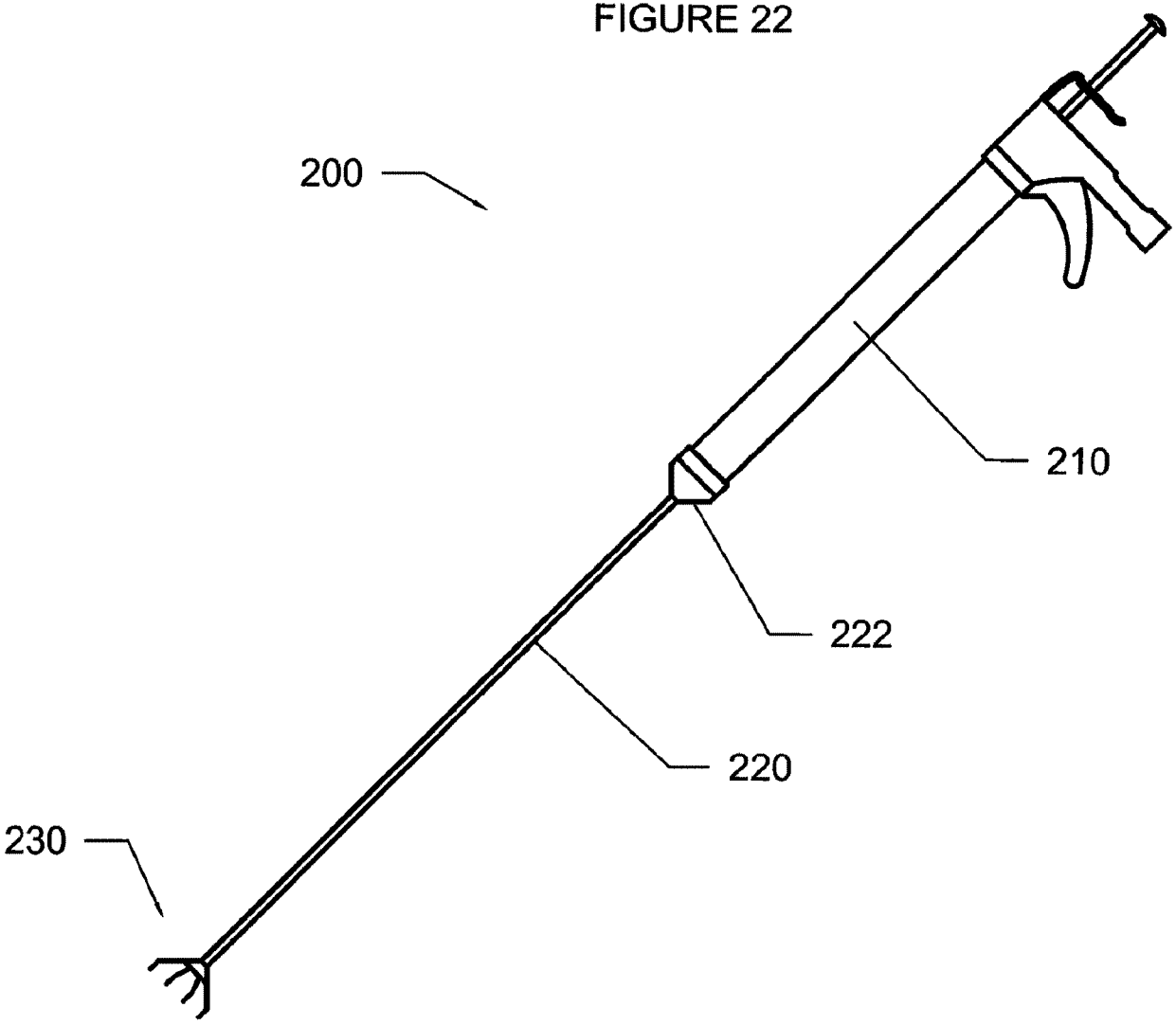
FIG. 22 is a perspective view of another embodiment of the shingle repair device with elongated support handle.
Figure 23:
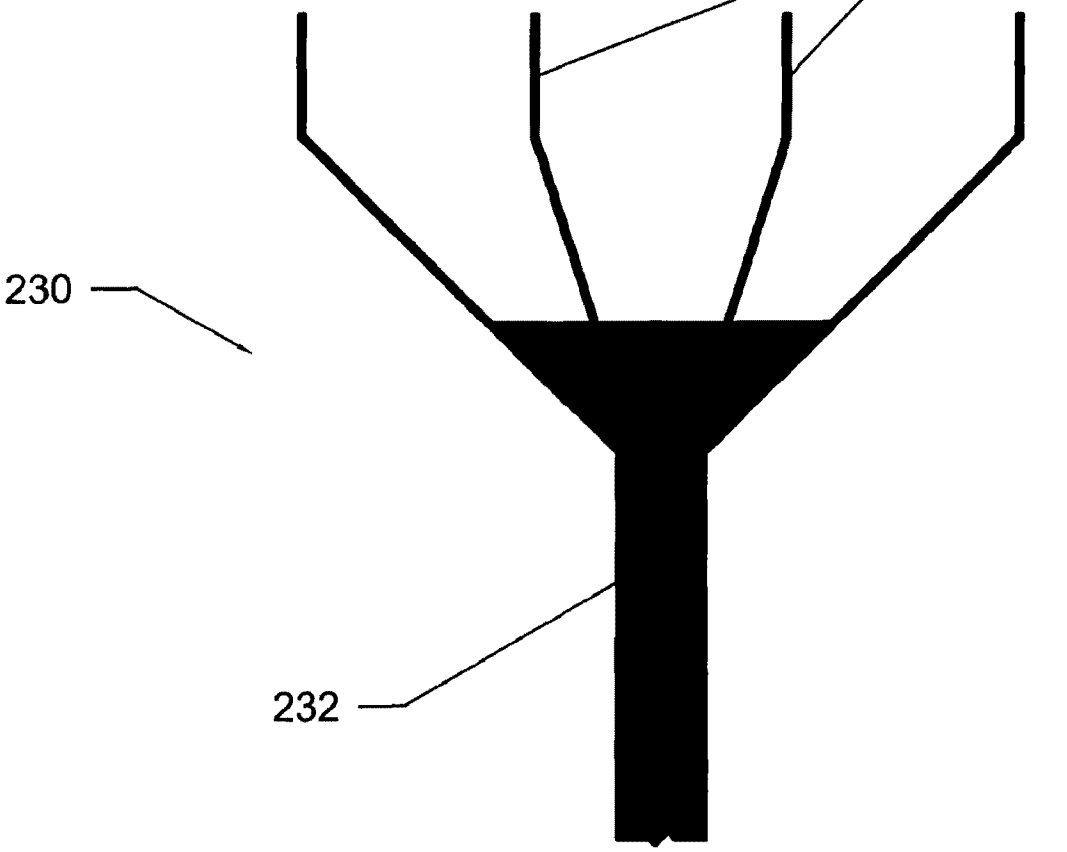
FIG. 23 is an enlarged view of the lift end of the shingle repair device of FIG. 22.

FIG. 22 is a perspective view of another embodiment of the shingle repair device with 200 elongated support handle 220. FIG. 23 is an enlarged view of the lift end 230 of the shingle repair device of FIG. 22.

Referring to FIGS. 22-23, this device 200 can use an elongated hollow rod handle 220 with a plurality of nozzles (dispensing tubes with bent ends at the dispensing end). The nozzles/tubes, can be formed from metal or rigid plastic and the like. A caulking gun 210 with trigger can be attached to the upper end of the hollow handle 220 by connector 222, which can connect to the tip of caulking tube mounted in the caulking gun. The squeezable trigger on the caulking gun 21 can dispense selected set amounts of the adhesive in a similar manner to the previous embodiments.

In addition, the dispensing nozzles/tubes 234 can include the lifting end portions of the previous embodiments, and be used with a squeezable trigger device with a pressure roller switch as described in the previous device 100.

The elongated handle 220 can have a length of approximately 0.5 feet to approximately 2.5 ft.

The elongated handle 220 can allow for the device to be held by the worker so that the flat bottom can rest on the roof surface. The front tip end of the nozzles/tubes 234 can be tapered to a blade tip end so that it provides minimal vertical displacement of the shingle when the device is inserted between the shingles.

The elongated handle 220 can ensure an ergonomic work arrangement. In operation, the worker can be in a kneeling position on one knee and gently pushes the device into the groove between the shingles with the second knee.

Although liquid adhesive is described, the liquid adhesive can have a tacky composition with different viscosity ranges.

Although a squeezable trigger is shown and described, other types of switches such as toggle switches, push buttons, and the like, can be used.

Figure 24:
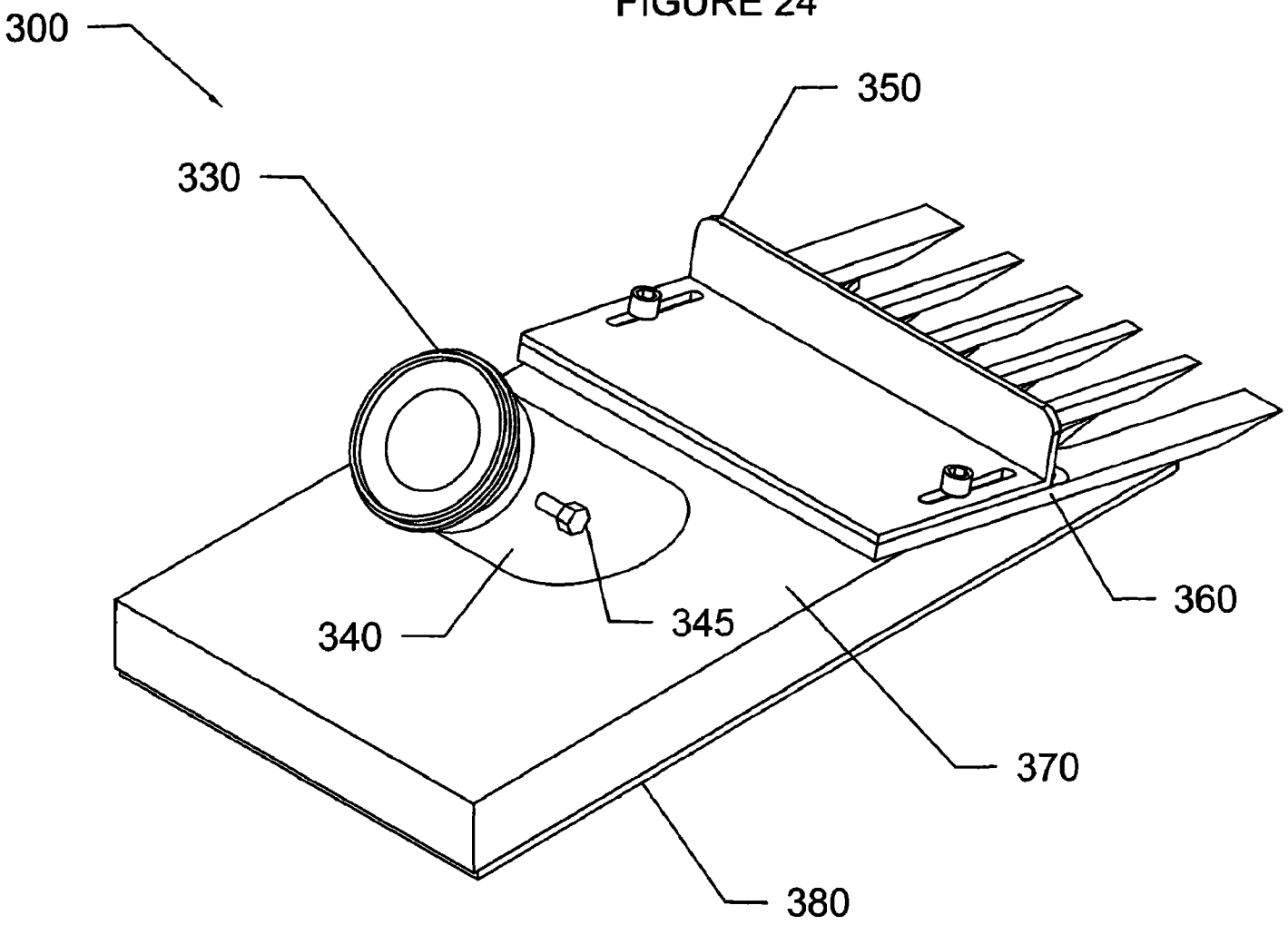
FIG. 24 is a top perspective rear view of another caulking gun adapter dispensing device embodiment.
Figure 25:
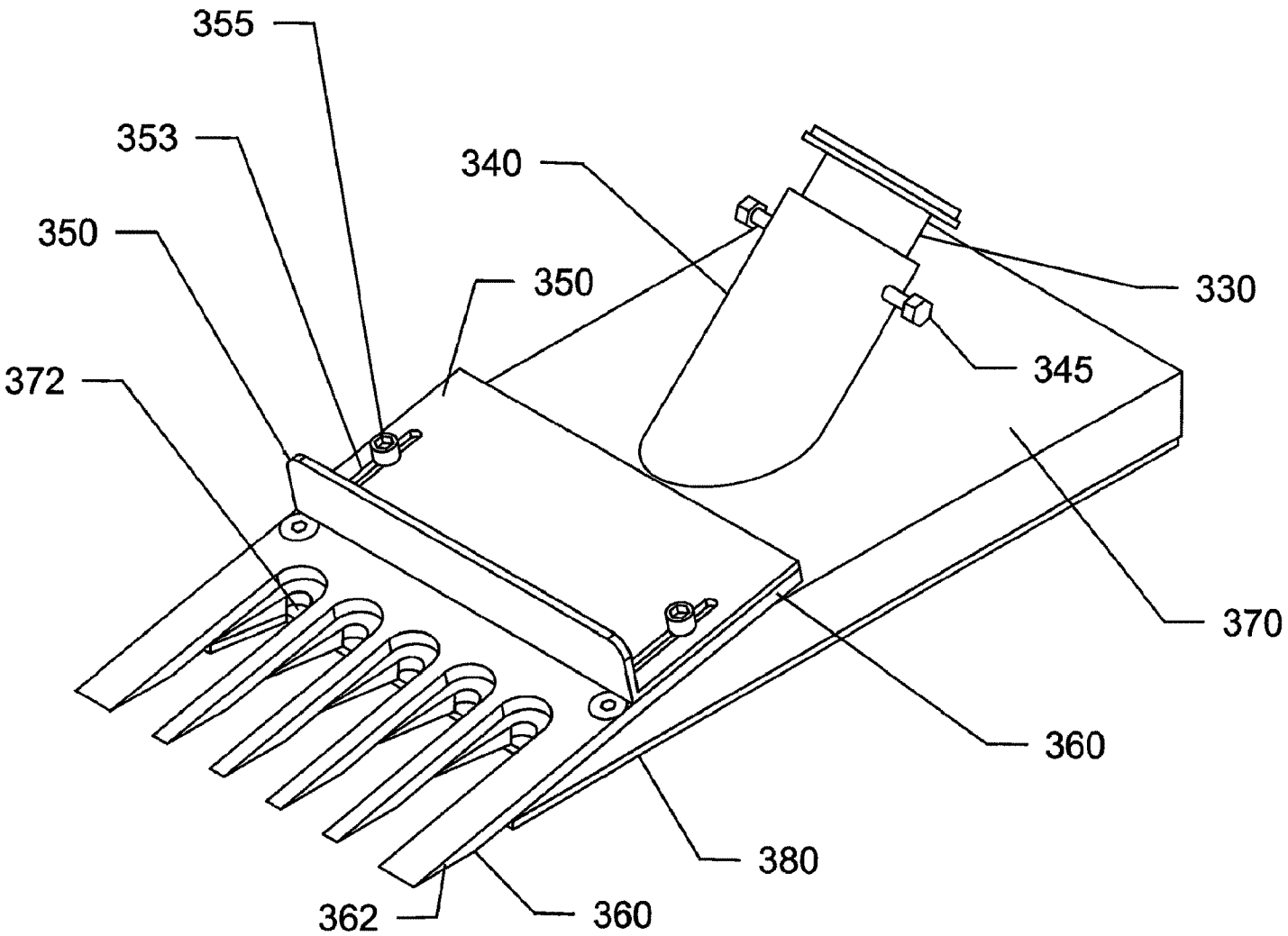
FIG. 25 is a to perspective front view of the adapter dispensing device of FIG. 24
Figure 26:
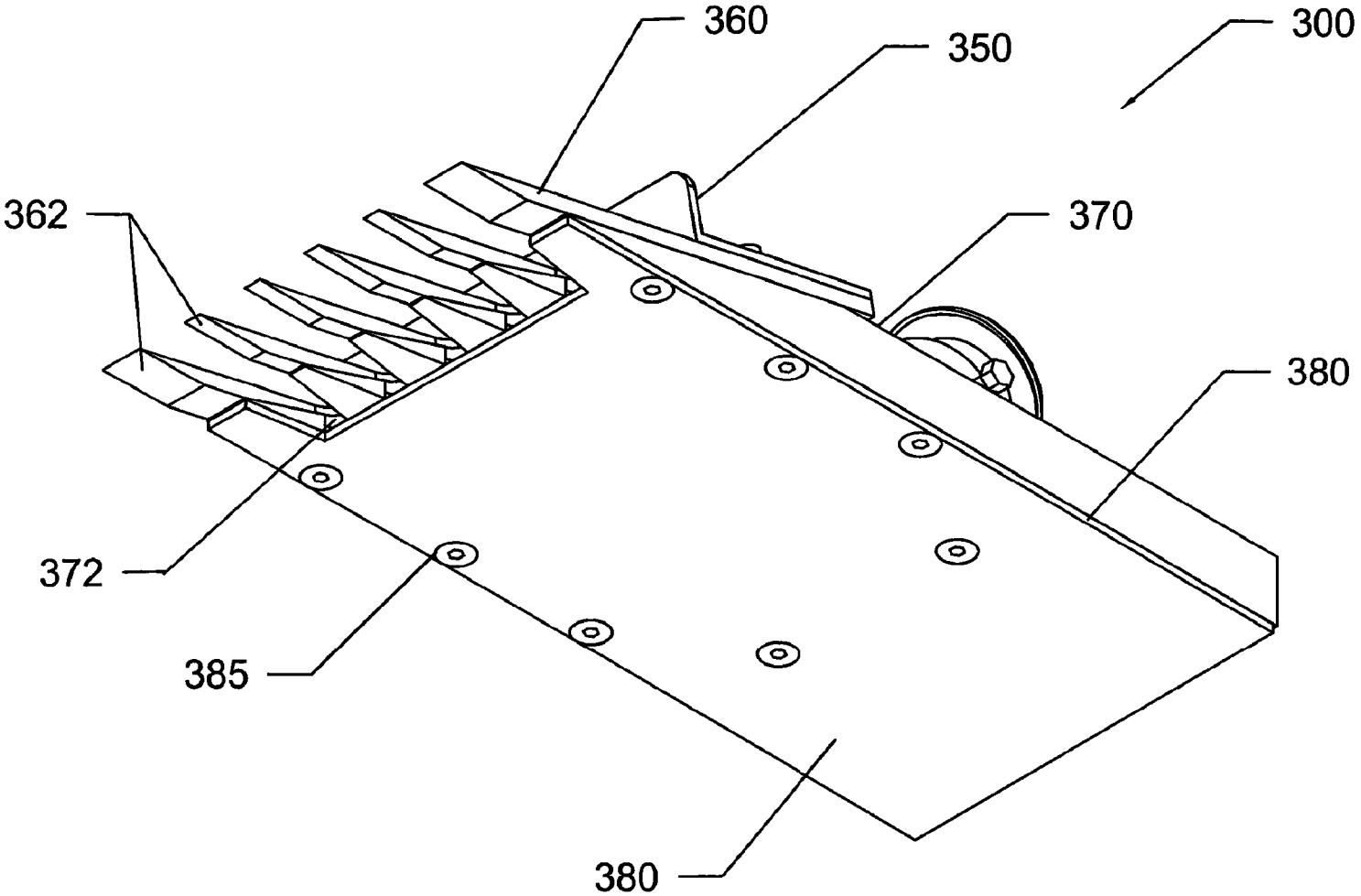
FIG. 26 is a bottom perspective view of dispensing device of FIG. 24.
Figure 27:
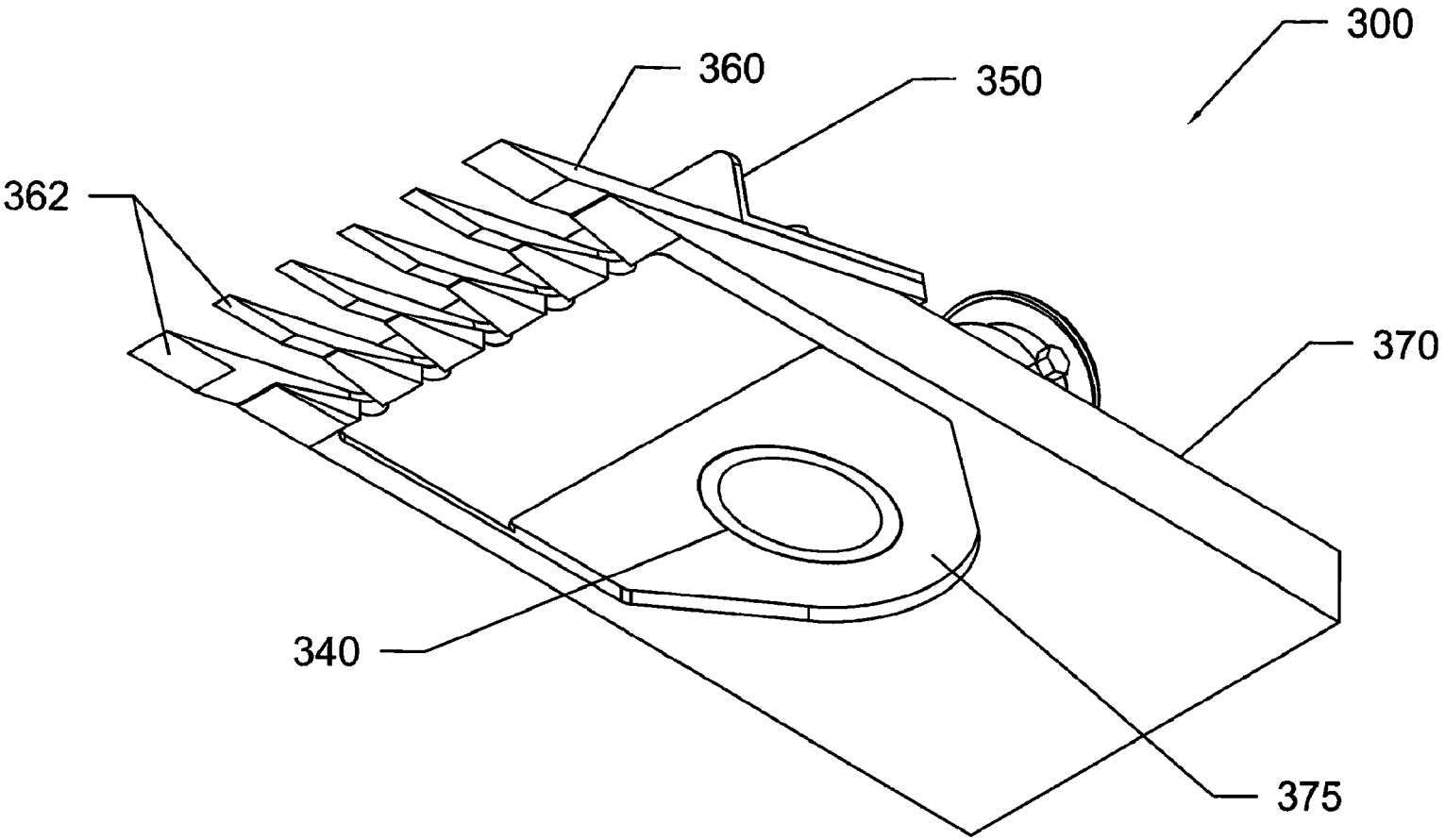
FIG. 27 is another bottom perspective view of the dispensing device of FIG. 26 with base plate removed.
Figure 28:
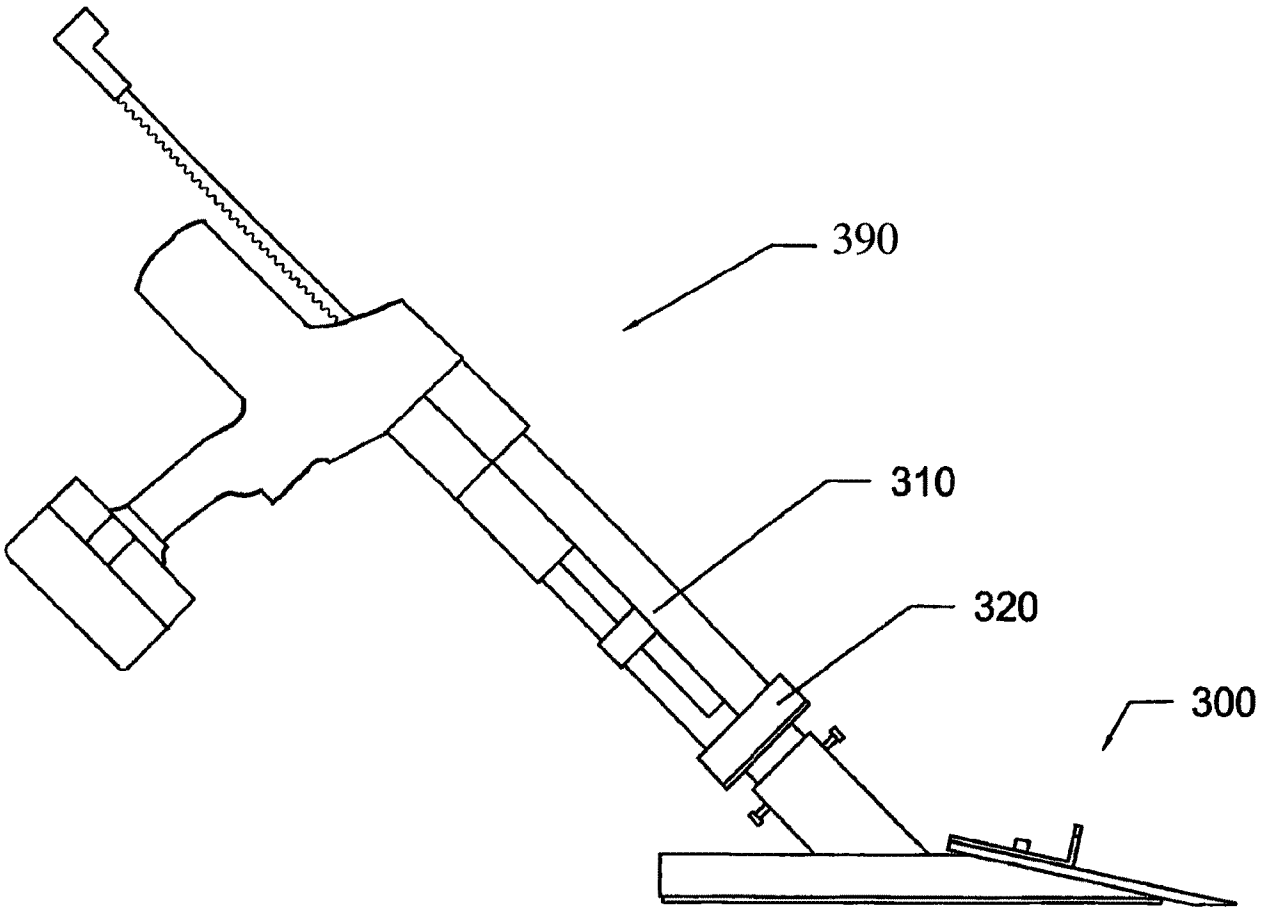
FIG. 28 is a side view of the dispensing device of FIGS. 24-27 used with another caulking gun.

FIG. 24 is a top perspective rear view of another caulking gun adapter dispensing device 300. FIG. 25 is a to perspective front view of the adapter dispensing device 300 of FIG. 24 FIG. 26 is a bottom perspective view of dispensing device 300 of FIG. 24. FIG. 27 is another bottom perspective view of the dispensing device 300 of FIG. 26 with base plate 380 removed. FIG. 28 is a side view of the dispensing device 300 of FIGS. 24-27 used with another caulking gun 380.

Referring to FIGS. 24-28, the device 300, a connector (plastic connector) 320 can be compressed fit within a cap end of an aluminum feed line 330, and interconnected within an outer end of a pipe 340 such as an aluminum pipe) by side fasteners 345, such as screws and bolts. The pipe 340 can be welded to the dispensing head of a main aluminum plate type body 370 that can be formed from aluminum. An adjustable L-shaped guide stop 350 can have slots 353, with fasteners 355, such as but not limited to bolts and screws, that allows the guide stop 350 to slide up and down on an inclined metal plate 360, such as a steel plate, and the like, which is on an inclined surface of an aluminum plate 370. The opposite end of the lift 360 can be spaced apart lifting ends 362, having spaced apart teeth. with channel openings 372 between base ends of the lifting ends 362.

The bottom of the device 300 can include a base plate 380 which can be attached and detached from the aluminum plate 370 (main body) by fasteners 385, such as screws, and the like, similar to the previous embodiment. An interior reservoir 375 can hold dispensing adhesive, similar to the previous embodiment, which can pass out of adhesive channels 372.

The connector 320 can attach to dispensing device 300 to one end of a caulking gun cartridge 310 that extends from a caulking gun 380. Device 300 can operate similar to the previous embodiments described above. A type of caulking gun 390 that can be used with the invention, can be a Milwaukee, Model #2642-21CT, M18 18-Volt Lithium-Ion Cordless 20 oz. Aluminum Sausage Style Caulk and Adhesive Gun Kit. See for example, http://www.homedepot.com/p/Milwaukee-M18-18-Colt-Lithium-Ion-Cordless-20-oz-Aluminum-Sausage-Style-Caulk-and-Adhesive-Gun-Kit-2642-21CT/203028012?quantity=1.

The term approximately, used through the application can include +/−10% of the numbered values that follow.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An applicator device for repairing shingle tabs on roofs, comprising:

a main plate-type body having a bottom surface and a top surface, where a first portion of the top surface is an inclined surface at a front lift end of the applicator device, where the inclined surface is at a sloped pitch angle with respect to a second portion of the top surface that is substantially parallel with the bottom surface, the main plate-type body comprising:

a dispenser adjacent to the front lift end, the dispenser having a plurality of channel openings that uniformly dispense a row of adhesive puddles at selected locations between partially unsealed shingles; and a reservoir configured to direct adhesive to the plurality of channel openings;

an angled metal lift layer having a proximal end attached to the inclined surface of the main plate-type body, where a distal end of the angled metal lift layer defines a tip of the front lift end; and a base plate removably attached to the bottom surface of the main plate-type body.

2. The applicator device of claim 1, further comprising a container of liquid adhesive under pressure attached to the main plate-type body.

3. The applicator device of claim 2, further comprising an air compressor attached to the container of liquid adhesive for applying the pressure to the liquid adhesive.

4. The applicator device of claim 1, further comprising a squeezable trigger for dispensing of the row of adhesive puddles.

5. The applicator device of claim 1, comprising a handle attached to a top of the applicator device.

6. The applicator device of claim 1, further comprising a plurality of parallel channels corresponding to the plurality of channel openings for dispensing the adhesive at the selected locations, wherein each channel of the plurality of channels is approximately 0.03 inches high by approximately 0.06 inches wide, and adjacent channels are spaced apart approximately 1 inch between centers of each channel.

7. The applicator device of claim 1, wherein the angled metal lift layer is tapered to a thin plate edge at the distal end.

8. The applicator device of claim 1, wherein the plurality of channel openings correspond to a plurality of cut-outs formed in the distal end of the angled metal lift layer.

9. The applicator device of claim 1, further comprising a guide stop affixed over the angled metal lift layer, where the guide stop limits an insertion distance of the applicator device between the partially unsealed shingles by contacting an edge of one of the partially unsealed shingles.

10. The applicator device of claim 9, wherein the guide stop is adjustable to set the insertion distance of the applicator device.

11. The applicator device of claim 1, wherein the main plate-type body is an aluminum plate.

12. The applicator device of claim 1, wherein the main plate-type body comprises fingers that extend between the plurality of channel openings.

13. The applicator device of claim 1, further comprising a feed port disposed in the second portion of the top surface of the main plate-type body, the feed port configured to deliver the adhesive to the reservoir.

14. The applicator device of claim 13, wherein the feed port is further configured to receive and secure a connector in fluid communication with a supply of the adhesive.

15. The applicator device of claim 13, wherein the feed port is further configured to receive and secure a connector attached to one end of a caulking gun.

16. An applicator device for repairing shingle tabs on roofs, comprising:

a main plate-type body having a bottom surface and a top surface, where a first portion of the top surface is an inclined surface at a front lift end of the applicator device, where the inclined surface is at a sloped pitch angle with respect to a second portion of the top surface that is substantially parallel with the bottom surface, the main plate-type body comprising:

a dispenser adjacent to the front lift end, the dispenser having a plurality of channel openings that uniformly dispense a row of adhesive puddles at spaced apart locations between partially unsealed shingles;

a reservoir configured to direct adhesive to the plurality of channel openings through corresponding channels; and a plurality of parallel replaceable tubes disposed in the corresponding channels for dispensing the adhesive at the spaced apart locations;

an angled metal lift layer having a proximal end attached to the inclined surface of the main plate-type body, where a distal end of the angled metal lift layer defines a tip of the front lift end; and a base plate removably attached to the bottom surface of the main plate-type body.

17. The applicator device of claim 16, wherein the plurality of parallel replaceable tubes are spaced apart approximately 1 inch between centers of each corresponding channel.

18. The applicator device of claim 16, wherein the plurality of parallel replaceable tubes include four tubes.

19. An applicator device for repairing shingle tabs on roofs, comprising:

a main plate-type body having a bottom surface and a top surface, where a first portion of the top surface is an inclined surface at a front lift end of the applicator device, where the inclined surface is at a sloped pitch angle with respect to a second portion of the top surface that is substantially parallel with the bottom surface, the main plate-type body comprising a dispenser adjacent to the front lift end, the dispenser having a plurality of channel openings that uniformly dispense a row of adhesive puddles at spaced apart locations between an upper shingle partially unsealed from a lower shingle;

an angled metal lift layer having a proximal end attached to the inclined surface of the main plate-type body, where a distal end of the angled metal lift layer defines a tip of the front lift end;

a base plate removably attached to the bottom surface of the main plate-type body; and a pivotable roller being moveable between a retracted position and an extended position, the pivotable roller configured to apply pressure to an upper surface of the upper shingle after dispensing the row of adhesive puddles from the dispenser.

20. The applicator device of claim 19, wherein the pivotable roller is supported by parallel control arms configured to move downward at pivot points in response to activation of a switch.

* * * * *